US012392534B2

(12) United States Patent
Sharma et al.

(10) Patent No.: US 12,392,534 B2
(45) Date of Patent: Aug. 19, 2025

(54) MECHANISM FOR REMOVABLY ASSEMBLING PLURALITY OFCOMPONENTS IN EVAPORATOR OF AN ICE MAKING MACHINE

(71) Applicants: Ram Prakash Sharma, Haryana (IN); Vinay Sharma, Gurugram (IN)

(72) Inventors: Ram Prakash Sharma, Haryana (IN); Vinay Sharma, Gurugram (IN)

( * ) Notice: Subject to any disclaimer, the term of this patent is extended or adjusted under 35 U.S.C. 154(b) by 234 days.

(21) Appl. No.: 18/249,874

(22) PCT Filed: Jun. 3, 2021

(86) PCT No.: PCT/IB2021/054861
§ 371 (c)(1),
(2) Date: Apr. 20, 2023

(87) PCT Pub. No.: WO2022/084757
PCT Pub. Date: Apr. 28, 2022

(65) Prior Publication Data

US 2023/0400239 A1 Dec. 14, 2023

(30) Foreign Application Priority Data

Oct. 23, 2020 (IN) ..... 202011046271

(51) Int. Cl.
*F25C 1/12* (2006.01)
*F28D 1/047* (2006.01)
(Continued)

(52) U.S. Cl.
CPC ..... *F25C 1/12* (2013.01); *F28D 1/0477* (2013.01); *F28F 1/325* (2013.01);
(Continued)

(58) Field of Classification Search
CPC ..... F25C 1/12; F25C 2400/12
See application file for complete search history.

(56) References Cited

U.S. PATENT DOCUMENTS 4,986,088 A * 1/1991 Nelson ..... F25C 1/12 62/347
4,995,245 A * 2/1991 Chang ..... F25C 1/12 62/347

(Continued)

FOREIGN PATENT DOCUMENTS

JP 61-165564 A 7/1986
JP 2006064317 A 3/2006

OTHER PUBLICATIONS

International Search Report dated Oct. 27, 2021 for PCT Appl. No. PCT/IB2021/054861.

(Continued)

*Primary Examiner* — Christopher R Zerphey
(74) *Attorney, Agent, or Firm* — Ohlandt, Greeley and Perle, L.L.P.

(57) ABSTRACT

An evaporator assembly for an ice making machine is disclosed. The evaporator assembly includes a first metal plate and a second metal plate accommodating a refrigerant tube. The first and second metal plates are defined with a plurality of projections (1*x* and 2*x*) extending from a first major surface. The plurality of projections (1*x* and 2*x*) defines a slot. The slots defined in the second major surface of first and second metal plates comprise a first connector and a second connector, respectively. At least one of the first metal plate and the second metal plate is movable relative to the other such that the first connector and second connector engage with each other secure the first metal plate and the second metal palate.

13 Claims, 15 Drawing Sheets

(51) Int. Cl.
*F28D 21/00* (2006.01)
*F28F 1/32* (2006.01)

(52) U.S. Cl.
CPC .. *F25C 2400/12* (2013.01); *F28D 2021/0064* (2013.01); *F28F 2215/10* (2013.01)

(56) References Cited

U.S. PATENT DOCUMENTS

| | | | | |
|---|---|---|---|---|
| 7,243,508 | B2 * | 7/2007 | Sanuki | F25C 1/12 62/298 |
| 2005/0252233 | A1 | 11/2005 | Sanuki | |
| 2007/0157652 | A1 * | 7/2007 | Hiramatsu | F25C 5/08 62/340 |
| 2019/0063814 | A1 | 2/2019 | Melton et al. | |

OTHER PUBLICATIONS

Written Opinion dated dated Oct. 27, 2021 for PCT Appl. No. PCT/IB2021/054861.

* cited by examiner

MECHANISM FOR REMOVABLY ASSEMBLING PLURALITY OFCOMPONENTS IN EVAPORATOR OF AN ICE MAKING MACHINE

TECHNICAL FIELD

Present disclosure in general relates to a field of thermodynamics. Particularly, but not exclusively, the present disclosure relates to an ice-making machine. Further, embodiments of the present disclosure disclose a removable evaporator assembly for the ice-making machine employed with a mechanism for easy removal of metal plates, of the evaporator assembly.

BACKGROUND OF THE DISCLOSURE

Ice is formed by exposing water to sub-zero temperatures. When water is exposed to freezing temperatures, water turns from a liquid state to a solid state. Ice of different shapes and sizes may be produced by moulds of predetermined shapes. Initially, water that is to be frozen is poured into a mould of predetermined shape. The mould is then exposed to sub-zero temperatures which causes the water in the mould to freeze. As the water turns into a solid state, the water acquires the shape of the mould and thus ice blocks in the shape of the mould are obtained. Generally, household refrigerators use ice trays with a more common cubical shaped ice tray, wherein the refrigerators and the ice trays are suitable to produce a small amount of ice. However, certain sectors such as the food sector, the beverage sector, the cold storage sectors etc. use large quantities of ice with specific requirement in shape and size. Ice of smaller sizes are generally used in the food/beverage sectors such as restaurants and hotels. In recent times, the food and beverage industries have had an increased demand for ice. Hence, there exists a need in the food/beverage sector to manufacture ice in large quantities in a shorter period. The different shapes of ice that may be served in the food and the beverage industries also seem to be aesthetically pleasing to the consumers.

Typically, ice blocks may be created by pouring water or liquid into mould of predetermined shape and these moulds would be subjected to sub-zero temperatures to form ice. However, such process is time consuming and tedious and thus production of large quantities of ice becomes difficult. Also, the ice blocks that are produced conventionally may break during harvest.

With advancements in the technology, automatic ice making machines have been developed and used in many sectors. These automatic ice making machines minimize human intervention by making ice in required shape and size. Ice making machines are often adapted in sectors which require ice in bulk quantities such as food or beverage sectors. Ice making machines comprise of a fluid tank which stores the water that is to be frozen. The water from the fluid tank may be fed by a pump to a water flow line. The water from the water flow line further flows onto a plurality of cooling surfaces on an evaporator. The plurality of cooling surfaces of the evaporator may comprise a first conductive plate and a second conductive plate. A refrigerant tube may be sandwiched between the first conductive plate and the second conductive plate. Further, the first conductive plate, the second conductive plate and the refrigerant tube may be connected by thermal joining process such as tin welding or soldering. As the refrigerant flows through the refrigerant tubes, the water that flows on the outer surfaces of the first conductive plate and the second conductive plate turns into ice since the heat from the water is absorbed by the refrigerant tubes through the first and the second conductive plate. The first and the second conductive plates form the cooling surface which cools and solidifies the water that flows on it. As the water solidifies on the cooling surface, the ice that is being formed takes the shape of the refrigerant tube and forms a semi-cylindrical shaped ice blocks. The ice is further harvested by circulating hot water on the inner surface of the metal Plates and refrigerant tube. The fresh water causes the ice formed on the surface of the first and the second conductive plate to partially melt and drop down into a storage container.

In the above-mentioned design of the evaporator, the first conductive plate and the second conductive plate are fixedly connected to the refrigerant tube by tin welding. The first and the second conductive plates are configured opposite to each other and the refrigerant tube is sandwiched between the first and the second conductive plate. Since, the refrigerant tube, the first conductive plate and the second conductive plate of the evaporator are fixedly welded together, the evaporator cannot be dis-assembled easily. Also, due to the constant water flow on the surface of the refrigerant tube during the harvest cycle bacterial formation on the refrigerant tubes becomes imminent. It is often not possible to clean the external surfaces of the refrigerant tube due to lack of accessibility. Since all the components of the evaporator are welded together, dis-assembling the evaporator for cleaning the bacterial formation on the surface of the refrigerant tubes is also not possible. Consequently, extremely strong cleaning agents are often used to remove the bacterial formation on the refrigerant tube and these cleaning agents at times may mix with the water flow during the harvest cycle, thereby contaminate the ice blocks that are formed. Since the bacteria formed on the surface of the refrigerant tube is not cleaned due to lack of accessibility, the water flowing through the contaminated surfaces will also be fouled. When the same fouled water is recirculated for ice formation, the formed ice blocks would also be extremely un-hygienic.

Further, in conventional evaporator assemblies as mentioned above, heat from the flowing water is often absorbed by the refrigerant in the refrigerant tubes through an intermediate surface such as the first and the second conductive plates. These plates are generally made up of Low Conductivity Metal like Stainless Steel which is not a good Conductor hence the overall efficiency of the evaporator assembly may be significantly low. Thus, the overall cold storage energy of the refrigerant which is required to cool the stream of flowing water significantly increases. Also, since the heat transfer between the refrigerant tubes and the stream of flowing water takes place by an intermediate first and second conductive plates, the operational temperature at which the refrigerant flow through the refrigerant tubes has to be significantly decreased or the duration for which the refrigerant is circulated through the refrigerant tubes has to be significantly increased for the ice to be formed on the first conductive plate and the second conductive plate. Hence, the conventional evaporator assemblies often require more time for the ice to be produced and the subsequent operational temperature of the refrigerant would be significantly low. Consequently, the overall operational costs of the evaporator assembly increase significantly.

The present disclosure is directed to overcome one or more limitations stated above or any other limitation associated with the conventional arts.

SUMMARY OF THE DISCLOSURE

One or more shortcomings of the conventional systems are overcome by providing an evaporator assembly that can be disassembled easily for cleaning. The evaporator comprises of a plurality of connectors which hold a first metal plate, a second metal plate and refrigerant tube together. The evaporator also comprises of a first flange configured to the first metal plate and a second flange configured to the second metal plate, where the first and the second flanges are held together by a fastener.

In one non-limiting embodiment of the present disclosure, an evaporator assembly for an ice making machine is disclosed. The evaporator assembly includes a first low conductivity metal plate and a second low conductivity metal plate made up of stainless steel or similar metal accommodating a refrigerant tube. The first metal plate and the second metal plate is defined with a plurality of projections extending from a first major surface, where each of the plurality of projections defines a slot in a second major surface opposite to the first major surface of corresponding first metal plate and the second metal plate. The one or more slots defined in the second major surface of first metal plate comprises a plurality first connectors, and the one or more slots defined in the second major surface of second metal plate comprises a plurality of second connector. The second major surface of each of the first metal plate and the second metal plate contacts the refrigerant tube when the first metal plate and the second metal plate are connected. At least one of the first metal plate and the second metal plate is movable relative to the other such that the plurality first connectors and the plurality of second connector removably engage with each other to secure the first metal plate and the second metal plate when the at least one of the first metal plate and the second metal plate is moved in a first direction.

In an embodiment of the disclosure, the plurality of first connectors and the plurality of second connectors disengage with each other and separate the first metal plate and the second metal plate when the first metal plate and the second metal plate are moved in a second direction.

In an embodiment of the disclosure, the first projections and the second projections extend vertically along the length of the first and the second metal plate, respectively.

In an embodiment of the disclosure, the plurality of the plurality first connectors and the plurality of second connectors frictionally engage with each other.

In an embodiment of the disclosure, the plurality of first and second projections are defined equidistant from each other on respective first and second metal plate.

In an embodiment of the disclosure, where the plurality of first and second projections is of a "V" shaped configuration.

In an embodiment of the disclosure, the plurality of first and second projections on the first major surfaces defines a plurality of ice forming surfaces.

In an embodiment of the disclosure, the first metal plate and the second metal plate are defined by a plurality of cut outs that extend horizontally through-out the length of the first metal plate and the second metal plate for accommodating the refrigerant tube.

In an embodiment of the disclosure, a first flange is connected to one of the ends of the first metal plate and at least one second flange is connected to one of the ends of the second metal plate where, the first flange and the second flange fixedly secures the first metal plate, the second metal plate and the refrigerant tube.

In an embodiment of the disclosure, a housing at a rear end of the first metal plate is provided, wherein the housing accommodates an extension from a rear end of the second metal plate.

In an embodiment of the disclosure, the first metal plate and the second metal plate are of low thermal conductivity material and the refrigerant tube is of a high thermal conductivity material.

In an embodiment of the disclosure, the at least one second flange is defined with a hole for accommodating a first fastener and the first fastener dislodges the first metal plate against the second metal plate for disassembling the evaporator assembly.

In an embodiment of the disclosure, the refrigerant tube protrudes outwardly from the cut outs defined on the first and second metal plates In an embodiment, the refrigerant tube receives dispersed water to form ice blocks on the refrigerant tube such that a semi-circular shape is imparted to the ice blocks formed on the refrigerant tube.

In another non-limiting embodiment of the present disclosure, a method of assembling an evaporator assembly in an ice making machine is disclosed. The method includes the steps of aligning a first metal plate and a second metal plate adjacent to each other along with a refrigerant tube. The first metal plate and the second metal plate is defined with a plurality of projections extending from a first major surface, where each of the plurality of projections defines a slot in a second major surface opposite to the first major surface of corresponding first metal plate and the second metal plate. The one or more slots defined in the second major surface of first metal plate comprises a plurality of first connectors, and the one or more slots defined in the second major surface of second metal plate comprises a plurality of second connector. The next step involves sliding at least one of the first metal plate and the second metal plate in a first direction such that the plurality of first connectors and the plurality of second connector removably engage with each other to secure the first metal plate and the second metal plate. The final steps involves fastening at least one second fastener to a first hole of the first flange and a second hole of the second flange for fixedly connecting the first metal plate and the second metal plate.

In yet another non-limiting embodiment of the present disclosure, a vertical flow type ice making machine is disclosed. The machine includes one or more evaporator assemblies. Each of the one or more evaporator assembly includes a first metal plate and a second metal plate accommodating a refrigerant tube. The first metal plate and the second metal plate is defined with a plurality of projections extending from a first major surface, where each of the plurality of projections defines a slot in a second major surface opposite to the first major surface of corresponding first metal plate and the second metal plate. The one or more slots defined in the second major surface of first metal plate comprises a plurality of first connectors, and the one or more slots defined in the second major surface of second metal plate comprises a plurality of second connector. The second major surface of each of the first metal plate and the second metal plate contacts the refrigerant tube when the first metal plate and the second metal plate are connected. At least one of the first metal plate and the second metal plate is movable relative to the other such that the plurality of first connectors and the plurality of second connector removably engage with each other to secure the first metal plate and the second metal plate when the at least one of the first metal plate and the second metal plate is moved in a first direction.

The foregoing summary is illustrative only and is not intended to be in any way limiting. In addition to the illustrative aspects, embodiments, and features described above, further aspects, embodiments, and features will become apparent by reference to the drawings and the following description.

BRIEF DESCRIPTION OF THE ACCOMPANYING DRAWINGS

The novel features and characteristic of the disclosure are set forth in the appended description. The disclosure itself, however, as well as a preferred mode of use, further objectives, and advantages thereof will best be understood by reference to the following description of an illustrative embodiment when read in conjunction with the accompanying figures. One or more embodiments are now described, by way of example only, with reference to the accompanying figures wherein like reference numerals represent like elements and in which.

Figure 1:
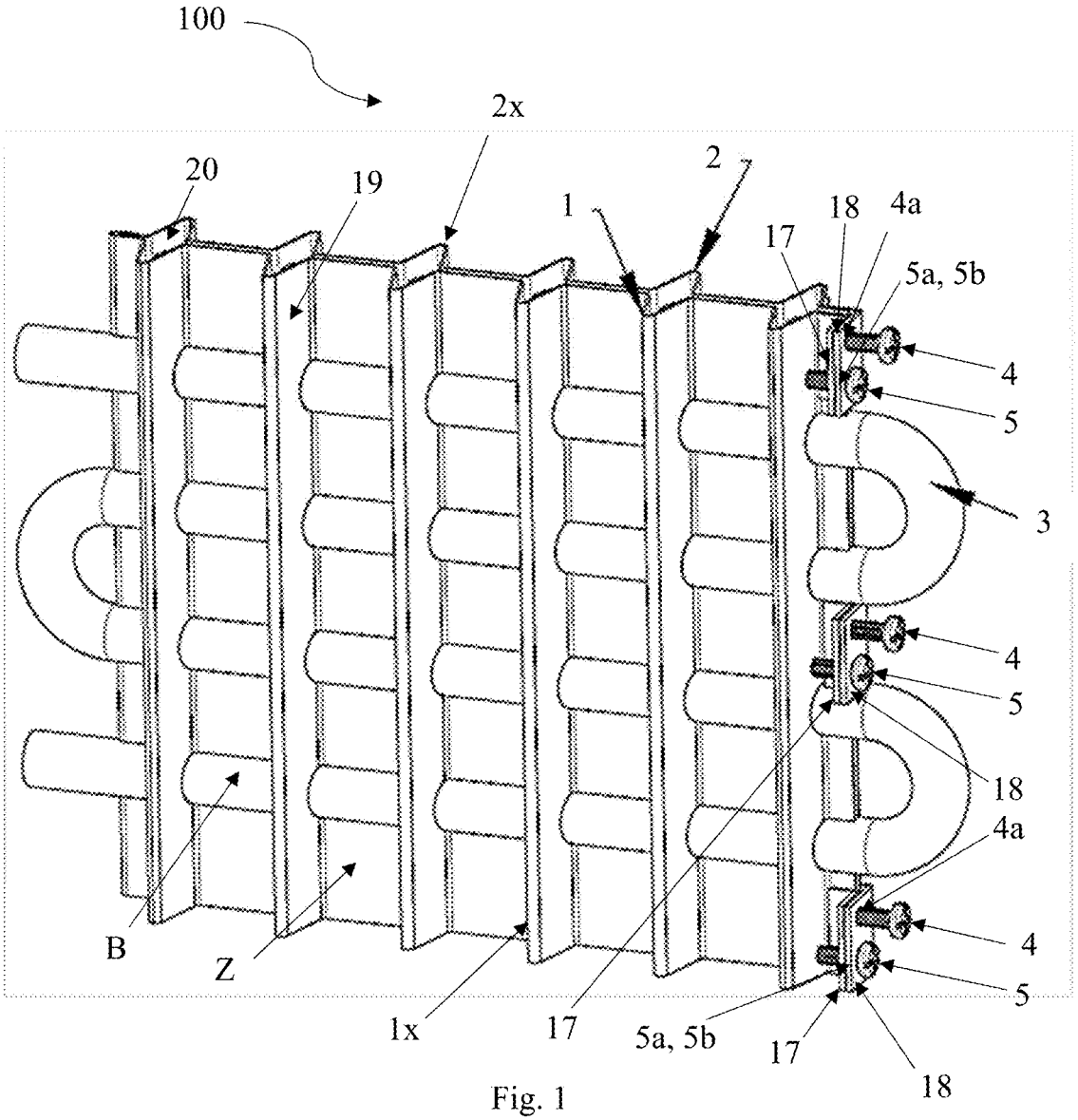
FIG. 1 illustrates a front perspective view of an evaporator, in accordance with an embodiment of the present disclosure.

The figures depict embodiments of the disclosure for purposes of illustration only. One skilled in the art will readily recognize from the following description that alternative embodiments of the system illustrated herein may be employed without departing from the principles of the disclosure described herein.

DETAILED DESCRIPTION

The foregoing has broadly outlined the features and technical advantages of the present disclosure in order that the description of the disclosure that follows may be better understood. Additional features and advantages of the disclosure will be described hereinafter which form the subject of the disclosure. It should be appreciated by those skilled in the art that the conception and specific embodiments disclosed may be readily utilized as a basis for modifying or designing other devices for carrying out the same purposes of the present disclosure. It should also be realized by those skilled in the art that such equivalent constructions do not depart from the spirit and scope of the disclosure. The novel features which are believed to be characteristics of the disclosure, as to its organization, together with further objects and advantages will be better understood from the following description when considered in connection with the accompanying figures. It is to be expressly understood, however, that each of the figures is provided for the purpose of illustration and description only and is not intended as a definition of the limits of the present disclosure.

In the present document, the word "exemplary" is used herein to mean "serving as an example, instance, or illustration." Any embodiment or implementation of the present subject matter described herein as "exemplary" is not necessarily to be construed as preferred or advantageous over other embodiments.

While the disclosure is susceptible to various modifications and alternative forms, specific embodiments thereof have been shown by way of example in the drawings and will be described below. It should be understood, however that it is not intended to limit the disclosure to the particular forms disclosed, but on the contrary, the disclosure is to cover all modifications, equivalents, and alternative falling within the scope of the disclosure.

The terms "comprises", "comprising", or any other variations thereof, are intended to cover a non-exclusive inclusion, such that an assembly that comprises a list of components does not include only those components but may include other components not expressly listed or inherent to such assembly. In other words, one or more elements in the device or assembly proceeded by "comprises . . . a" does not, without more constraints, preclude the existence of other elements or additional elements in the assembly.

Embodiments of the present disclosure discloses a mechanism for removable metal plates of components of an evaporator of an ice making machine. Conventionally, heat from the flowing water is often absorbed by the refrigerant in the refrigerant tubes through intermediate surfaces. The intermediate surfaces may be the surface of the refrigerant tube itself and the surface of the first metal plate or the second metal plate. Since the heat transfer between the refrigerant tubes and the stream of flowing water takes place through the intermediate plate, the operational temperature at which the refrigerant flows through the refrigerant tubes must be significantly decreased. Consequently, the efficiency of the ice making machine is reduced and the overall operational costs of the evaporator assembly increase. Further, the refrigerant tube, the first metal plate and the second metal plate of the evaporator are fixedly welded together due to which the evaporator cannot be dis-assembled. Also, the constant water flow on the surface of the refrigerant tube during the harvest cycle causes bacterial formation on the refrigerant tubes which results in the formation of unhygienic ice blocks.

Accordingly, the present disclosure discloses an evaporator assembly for an ice making machine. The evaporator assembly includes a first metal plate and a second metal plate accommodating a refrigerant tube. The first metal plate and the second metal plate is defined with a plurality of projections extending from a first major surface, where each of the plurality of projections defines a slot in a second major surface opposite to the first major surface of corresponding first metal plate and the second metal plate. The one or more slots defined in the second major surface of first metal plate comprises a plurality of first connectors, and the one or more slots defined in the second major surface of second metal plate comprises a plurality of second connector. The second major surface of each of the first metal plate and the second metal plate contacts the refrigerant tube when the first metal plate and the second metal plate are connected. At least one of the first metal plate and the second metal plate is movable relative to the other such that the plurality of first connectors and the plurality of second connector engage with each other to secure the first metal plate and the second metal plate when the at least one of the first metal plate and the second metal plate is moved in a first direction. The plurality of first connectors and the plurality of second connector disengage with each other and separate the first metal plate and the second metal plate when the first metal plate and the second metal plate are moved in a second direction.

Figure 2:
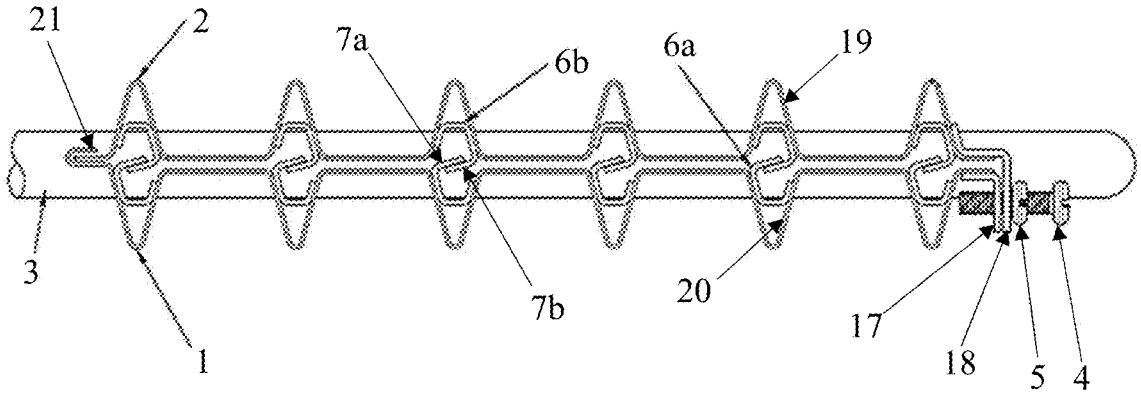
FIG. 2 illustrates a top view of the evaporator, in accordance with an embodiment of the present disclosure.

The following paragraphs describe the present disclosure with reference to FIG. 1 to 11. FIG. 1 illustrates a front perspective view of a removable evaporator assembly (100) and FIG. 2 illustrates a top perspective view of the removable evaporator assembly (100). The evaporator assembly (100) includes a refrigerant tube (3) which is provided or sandwiched between a first metal plate (1) and a second metal plate (2). The first metal plate (1) and the second metal plate (2) are configured to define a plurality of first and second projections (1*x* and 2*x*) respectively. The first metal plate (1) and the second metal plate (2) may be defined with the plurality of projections (1*x* and 2*x*) extending from a first major surface (19), where each of the plurality of projections (1*x* and 2*x*) may define a slot (S) in a corresponding second major surface (20) opposite to the first major surface (19) of corresponding first metal plate (1) and the second metal plate (2) respectively. The first metal plate (1) and the second metal plate (2) are formed or stamped such that the plurality of first projections (1*x*) and the second projections (2*x*) on the first and the second metal plate (1 and 2) respectively extend vertically throughout the length of the first and the second metal plate (1 and 2). The plurality of first and second projections (1*x* and 2*x*) defined on the first and the second metal plate (1 and 2) may be equidistant from each other and the plurality of first and second projections (1*x* and 2*x*) may be of a "V" shape. The plurality of first and second projections (1*x* and 2*x*) that extend vertically along the first and the second metal plate (1 and 2) may act as walls defining multiple ice forming surfaces (Z) for the formation of multiple blocks of ice. Further, the inner sections of the first metal plate (1) and the second metal plate (2) may be carved by a plurality of cut outs (16) that extend horizontally throughout or at least a position of the length of the first metal plate (1) and the second metal plate (2) [clearly seen from FIG. 9]. The cut outs (16) carved out into the first metal plate (1) and the second metal plate (2) may be configured at the top end of the "V" shaped projections (1*x* and 2*x*) and along the ice forming surface (Z) of the first metal plate (1) and the second metal plate (2). The cut outs (16) carved out in the first metal plate (1) and the second metal plate (2) may individually be of a semi-circular shape and the cut outs (16) may form a complete circular passageway when the first metal plate (1) and the second metal plate (2) are aligned together. The circular cut outs (16) may extend along the central region of the evaporator assembly (100) and the cut outs (16) carved on to the first metal plate (1) and the second metal plate (2) may be configured to compactly accommodate the refrigerant tube (3). The refrigerant tube (3) protrudes outwardly from the cut outs (16) in the first and second metal plates (1 and 2). The refrigerant tube (3) receives dispersed water to form ice blocks (11) on the refrigerant tube (3) such that a semi-circular shape is imparted to the ice blocks (11) formed on the refrigerant tube (3). The semi-circular cut outs (16) carved into the first metal plate (1) and the second metal plate (2) may be of the same diameter or of a size slightly larger diameter than the refrigerant tube (3) such that the refrigerant tube (3) is suitably accommodated inside of the cut outs (16). The front end of the first metal plate (1) may be configured to define at least one first flange (17) and the second metal plate (2) may also be configured to define at least one second flange (18). The first flange (17) and the second flange (18) may be defined in a direction perpendicular to the ice forming surface (Z). The first flange (17) and the second flange (18) may be an integral part of the first metal plate (1) and the second metal plate (2) respectively and may be stamped or deformed in a direction perpendicular to the ice forming surfaces (Z). The first flange (17) and the second flange (18) may extend between the refrigerant tubes (3) as seen from FIG. 1. Further, each of the plurality of first flange (17) may be defined with a first hole or aperture (5*a*) that extends through the first flange (17) and each of the plurality of second flange (18) may be defined with a second hole (5*b*) that extend through the second flange (18) [clearly seen from FIG. 8]. The first hole (5*a*) and the second hole (5*h*) on the first flange (17) and the second flange (18) respectively may be configured to lie along the same axis when the first flange (17) and the second flange (18) that are positioned adjacent to each other. The first hole (5*a*) and the second hole (5*b*) of the first flange (17) and the second flange (18) respectively, may accommodate a second fastener (5). In an embodiment, the second fastener (5) is a clamping screw (5). The second fastener (5) may be defined with threads which match the threads of the first hole (5*a*) and the second hole (5*b*). The second fastener (0.5) may be fastened into the first hole (5*a*) and the second hole (5*b*) of the first flange (17) and the second flange (18) respectively such that the first flange (17) is fixedly connected to the second flange (18). Further, the second flange (18) may be defined by a third hole (4*a*) which extends through the second flange (18). The third hole (4*a*) may be configured to accommodate a first fastener (4) and the threads of the third hole (4*a*) may mesh with the threads defined on the first fastener (4). With further reference to FIG. 2, the rear end of the first metal plate (1) may be configured or deformed to form a "U" shaped housing (21)

and the rear end of the second metal plate (2) may be an elongated member which is housed inside the housing (21) of the first metal plate (1).

The one or more slots (S) defined in the second major surface (20) of first metal plate (1) accommodates a plurality of first connectors (6*a*), and the one or more slots (S) defined in the second major surface (20) of second metal plate (2) accommodates a plurality of second connectors (6*b*). The inner surfaces of each of the "V" shaped first and second projections (1*x* and 2*x*) may be provided with the plurality of first connectors (6*a*) and the plurality of second connectors (6*b*) respectively. As seen from the FIG. 2, the inner surfaces of each of the "V" shaped first projections (1*x*) on the first metal plate (1) are provided with plurality of first connectors (6*a*). The plurality of first connectors (6*a*) may be provided throughout the length of each of the first projections (1*x*) of the first metal plate (1). Further, the plurality of first connectors (6*a*) may be "C" shaped members with a mechanical joining means (7). In an embodiment, the mechanical joining means (7) is a first tension member (7*a*). The plurality of first connectors (6*a*) may be fixedly connected to the inner surfaces of the first projections (1*x*) by thermal joining process such as welding. Similarly, the inner surfaces of each of the "V" shaped second projections (2*x*) on the second metal plate (2) are provided with the plurality of second connectors (6*h*). The plurality of second connectors (6*b*) may be provided throughout the length of each of the second projections (2*x*) of the second metal plate (2). Further, the plurality of second connectors (6*b*) may be "C" shaped members with a mechanical joining means where, the mechanical joining means is a second tension member (7*h*). The plurality of second connectors (6*b*) may be fixedly connected to the inner surfaces of the second projections (2*x*) by thermal joining process such as welding.

The refrigerant tube (3) is fit in between the first metal plate (1) and the second metal plate (2) such that the refrigerant tube (3) is accommodated inside the cut outs (16) provided in the first metal plate (1) and the second metal plate (2). The first metal plate (l y and the second metal plate (2) are further held together by the plurality of first connectors (6*a*) and the plurality of second connectors (6*b*). The first tension member (7*a*) from the plurality of first connector (6*a*) frictionally contacts the second tension member (7*b*) from the plurality of second connector (6*b*). The assembling of the evaporator assembly (100) involves aligning the first metal plate (1) and the second metal plate (2) adjacent to each other along with the refrigerant tube (3). The next step involves sliding at least one of the first metal plate (1) and the second metal plate (2) in a first direction (X) such that the plurality of first connectors (6*a*) and the plurality of second connectors (6*b*) removably engage with each other to secure the first metal plate (1) and the second metal plate (2). While assembling the first metal plate (1), the second metal plate (2) and the refrigerant tube (3), the first metal plate (1) or the second metal plate (2) may be slid over the other plate such that the plurality of second connectors (6*b*) removably engage with the plurality of first connectors (6*a*) and the extension at the rear end of the second metal plate (2) is accommodated inside the housing (21) of the first metal plate (1). Consequently, the tugging force between the first and the second tension members (7*a* and 7*b*) ensures that the plurality of first and the second connectors (6*a* and 6*b*) are held together. Consequently, the first connectors (6*a*) housed in the projections (1*x*) of the first metal plate (1) and the plurality of second connectors (6*b*) housed in the projections (2*x*) second metal plate (2) ensure that the first metal plate (1) and the second metal plate (2) are held together by tension between the first and the second tension members (7*a* and 7*h*). Once, the first metal plate (1) and the second metal plate (2) are held together by the plurality of the first and the second connectors (6*a* and 6*b*), the first fastener (4) may further be fastened into the first hole (5*a*) of the first flange (17) and the second hole of the second flange (18), thereby connecting the first metal plate (1) and the second metal plate (2).

In an embodiment, the first metal plate (1) and the second metal plate (2) are made of low thermal conductivity material such as stainless steel and the refrigerant tube (3) is made of metal with high thermal conductivity such as copper coated with nickel. In an embodiment, limiting the usage of copper to the refrigerant tubes (3) ensures minimal usage of copper per Kg capacity of the Ice making machine and thereby a highly efficient and economical design of the evaporator assembly (100) is realised.

Figure 3:
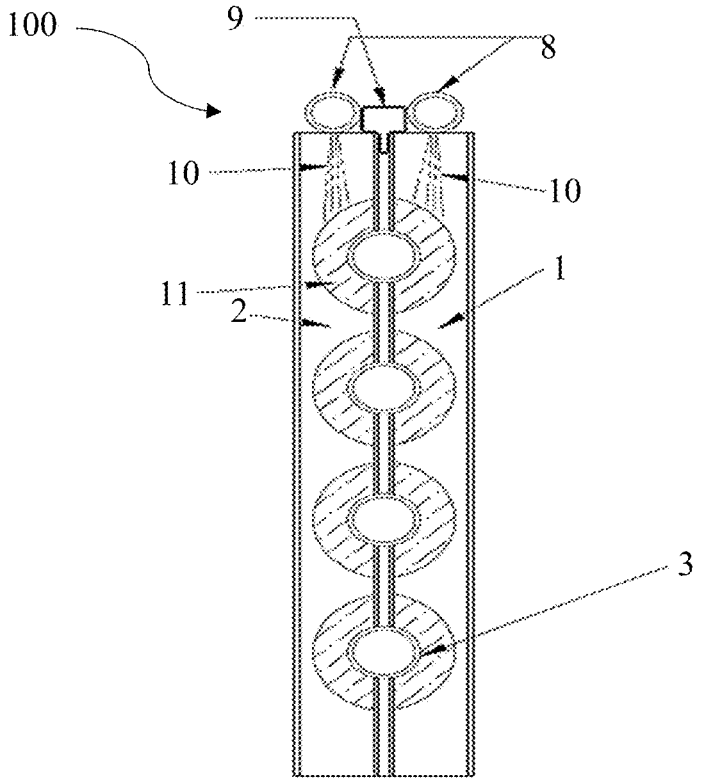
FIG. 3 illustrates a side view of the evaporator during a cooling/ice making cycle, in accordance with an embodiment of the present disclosure.
Figure 4:
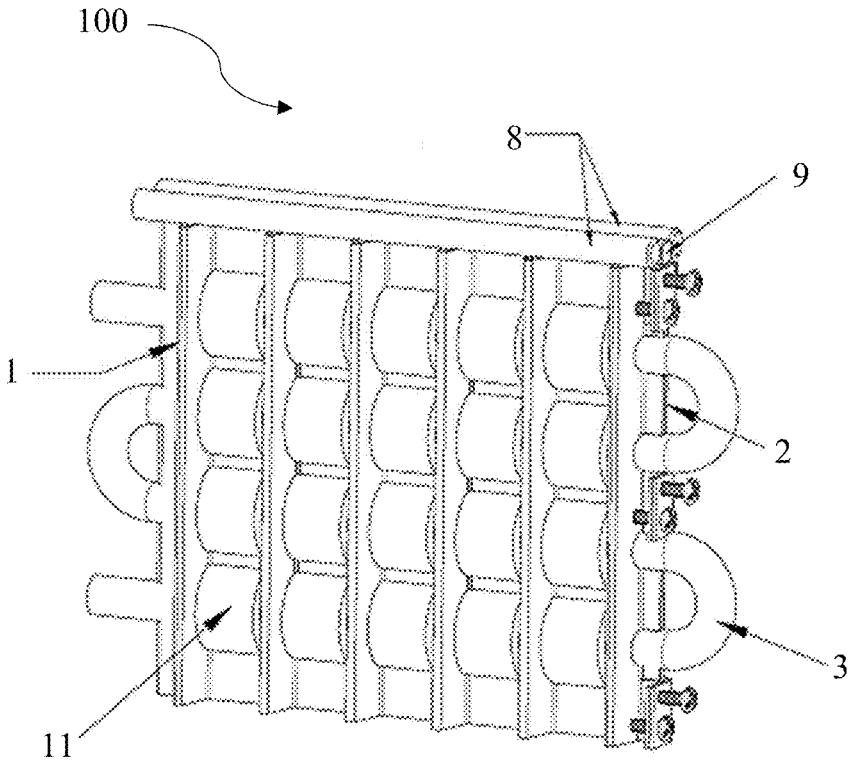
FIG. 4 illustrates a front perspective view of the evaporator, in accordance with an embodiment of the present disclosure.

FIG. 3 and FIG. 4 illustrate a side view and a front perspective view of the evaporator assembly (100) during a cooling cycle. As shown, a plurality of water flow lines (8) may be configured on top of the evaporator assembly (100). The water flow lines (8) may be configured to disperse water onto the ice forming surfaces (Z) of the first metal plate (1), the second metal plate (2) and the refrigerant tubes (3). Further, refrigerant may suitably be circulated through the refrigerant tubes (3). Water from a fluid tank (14) [seen from FIG. 10] may be pumped into the plurality of water flow lines (8). The water from the water flow lines (8), flows onto the plurality of ice forming surfaces (Z) through a plurality of apertures at the bottom of the water flow lines (8). The flow of water during the cooling cycle is clearly seen from FIG. 3. Further, the water flows on the plurality of ice forming surfaces (Z) and comes in direct contact with the surface (B) of the plurality of refrigerant tubes (3). Since, the water from the water flow lines (8) are guided directly onto the surface (B) of the refrigerant tubes (3), the ice is formed at a faster rate. Also, the overall operational efficiency of the evaporator assembly (100) is increases since the surface (B) of the refrigerant tube (3) comes in direct contact with the flowing water. As the water encounters the surface (B) of the refrigerant tube (3), it solidifies to ice and a semi-spherical shaped ice block is formed on either side of the refrigerant tube (3). With continued flow of water over the surface (B) of refrigerant tubes (3), additional layers of ice are formed on the already existing layers of ice (11).

As seen from the FIG. 4, multiple semi cylindrical shaped ice blocks are formed around the surface (B) of the refrigerant tube (3) and the ice forming surfaces (Z) of the first metal plate (1) and the second metal plate (2). As seen from the FIG. 3, the water flow during the cooling cycle is initially directed onto the plurality of ice forming surfaces (Z) and the surface (B) of the refrigerant tubes (3). The water flows onto the refrigerant tube (3) where the refrigerant in the refrigerant tube (3) absorbs the heat from the water and causes it to solidify on the surface (B) of the refrigerant tube (3). The ice is thus directly formed on the surface of the refrigerant tube (3). Further, as additional water is circulated through the ice forming surfaces (Z) of the first and second metal plate (1 and 2), the water further solidifies on the already formed layer of ice on the refrigerant tube (3). Thus, the ice is gradually formed in form of layers. As the layers of ice that is formed around the refrigerant tube (3) increases, the ice gradually takes a semi-cylindrical shape. The Water gradually flows through all the surfaces (B) of the refrigerant tubes (3). The water that is not frozen or solidified in the first surface (B1) of the refrigerant tubes (3), flows to the next or the second surface (B2) of the refrigerant tubes (3). Further, only certain amount of water that flows on the second surface (B2) solidifies, whereas the excessive water flows to the third surface (B3) by means of the ice forming surfaces (Z). This flow of water continues through all the surfaces (B) of the refrigerant tubes (3). Any remaining water that is not frozen or solidified on the last surface (B4) of the refrigerant tube (3) flows into the fluid/water tank (14) that is housed below the evaporator assembly (100).

Thus, the ice is gradually formed in a layer-by-layer manner until complete semi-cylindrical shaped ice blocks are obtained. Since the refrigerant tube (3) directly acts as the base surface (B) for the formation of ice, the heat transfer between the water that flows on the refrigerant tube (3) and the refrigerant inside the refrigerant tube (3) is abundant. Further, since the surface (B) of the refrigerant tube (3) itself directly acts as the ice forming surface, there exists minimal thermal losses while the water solidifies to ice. Therefore, the rate or the time required for the ice to be formed is drastically improved and the overall operational efficiency of the evaporator assembly (100) is also improved.

Figure 5:
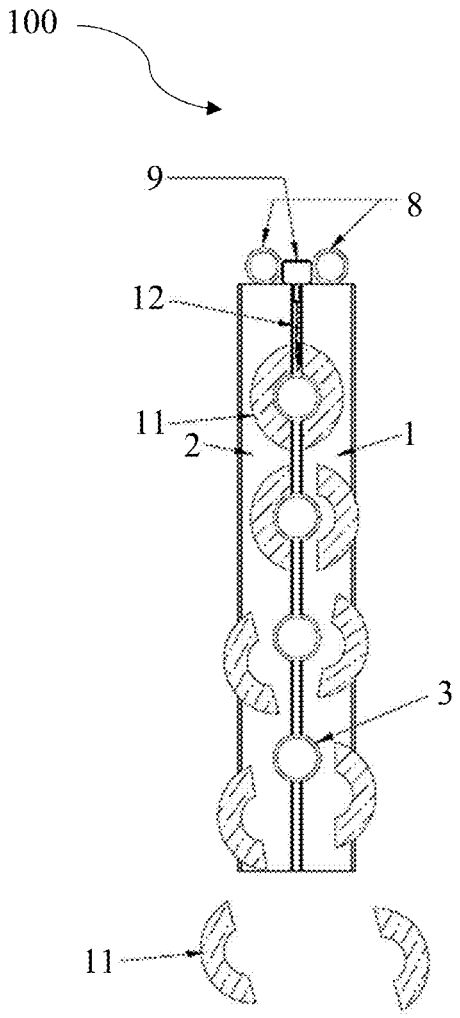
FIG. 5 and FIG. 6 illustrates a side view of the evaporator during a harvest cycle, in accordance with an embodiment of the present disclosure.
Figure 6:
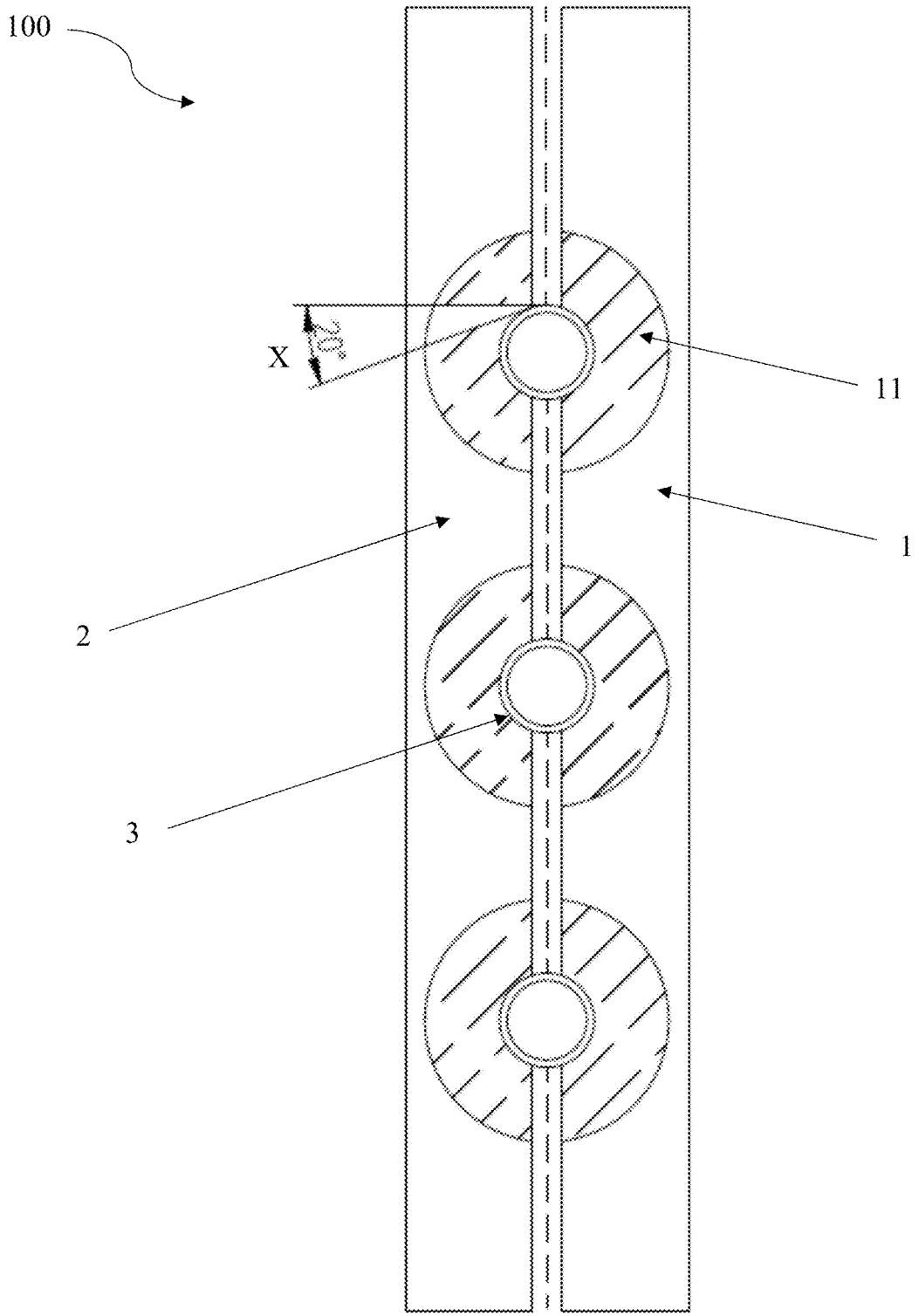

FIG. 5 and FIG. 6 illustrates a side view of the evaporator assembly (100) during the harvest cycle. As seen in FIG. 5, a fresh water line (9) is provided on the top of the evaporator assembly (100). The defrost fluid is supplied to the fresh water line (9) by means a pump or any other suitable means from a defrost fluid tank. The defrost fluid may be circulated between the first metal plate (1) and the second metal plate (2) such that the defrost fluid falls directly onto the inner surface of the refrigerant tubes (3), as well as the inner surface of the first and second metal plates (1 and 2). The defrost fluid is fresh water and is generally at a higher temperature. Defrost fluid is dispersed such that it comes in direct contact with the inner surface of the refrigerant tube (3) as well as the first and second metal plates (1 and 2). The defrost fluid is sprayed by suitable means onto the plurality of refrigerant tubes (3). The defrost fluid is sprayed onto the plurality of refrigerant tubes (3), only when the ice is completely formed. At the start of the defrost cycle the hot refrigerant fluid starts flowing through the refrigerant tube (3), when the hot defrost fluid meets the refrigerant tube (3), the overall temperature of the refrigerant tube (3) increases. This increase in temperature of the refrigerant tube (3), causes the ice that is formed on the surface (B) of the plurality of refrigerant tubes (3) to partially melt. As the ice partially melts from the surface (B) of the refrigerant tube (3), the ice blocks get detached from the surface (B) of the plurality of refrigerant tubes (3). The ice blocks that are now separated from the refrigerant tubes (3) gradually falls as seen from the FIG. 5.

In an embodiment of the disclosure, the defrost fluid may be directly circulated through the plurality of refrigerant tubes (3) during the harvest cycle.

In an embodiment of the disclosure, the cooling cycle and the harvest cycle may operate for a predetermined amount of time, wherein the predetermined amount of time may be the minimum time required for the ice to be formed during the cooling cycle and the minimum amount of time required for the ice to be detached from the refrigerant tubes (3) during the harvest cycle. The water level may be controlled during the cooling cycle and the temperature of evaporator may be controlled during the defrost cycle through a control unit.

In an embodiment of the disclosure, the surface of the refrigerant tubes (3) may be coated with Nickel or any other suitable non corrosive long lasting food grade electrolysis coating to prevent erosion and/or corrosion for avoiding the formation of bacteria on the surface (B) of the refrigerant tubes (3).

The cooling and the harvest cycle may be completed multiple times and after a pre-determined number of cycles, the evaporator assembly (100) must be cleaned. After multiple cycles of cooling and harvesting if the evaporator is not properly cleaned a significant amount of bacteria may build up on the surface (B) of the refrigerant tubes (3) and on the back surfaces (Z) of the first and second metal plate (1 and 2). Consequently, disassembling and cleaning of the evaporator assembly (100) becomes necessary. Further, due to the constant flow of water over the plurality of the first and the second connectors (6*a* and 6*h*), a significant amount of calcium in the water may build up on the connectors (6) and other joints of the evaporator assembly (100). For instance, there may be a significant amount of calcium deposit between the first flange (17), second flange (18) and the connectors (6) due to which disassembly becomes difficult. Further, the evaporator assembly (100) is disassembled for cleaning in the following manner.

With reference to FIG. 6, the angle of incidence for the defrost fluid ranges from 18 degrees to 22 degrees. Angle of incidence is defined between a vertical line from the top surface of the refrigerant tube (3) and a tangential line from the surface of the refrigerant tube (3) coming in contact with at least one of the first metal plate (1) and the second metal plate (2). Generally, the defrost fluid flows between the first metal plate (1) and the second metal plate (2) as indicated by the dotted lines in the FIG. 6. The defrost fluid comes in contact with an outer surface of the refrigerant tube (3) and heats up the refrigerant within the refrigerant tube (3). Subsequently, the ice blocks (11) are partially heated and are released from the evaporator assembly (100) in the above-mentioned manner. Further, the first metal plate (1) and the second metal plate (2) are spaced apart such that the angle of incidence (X) for the defrost fluid may lie between 18 degrees to 22 degrees, preferably 20 degrees. Thus, the defrost fluid falling on the refrigerant tube (3) is exposed to a larger surface area of the refrigerant tube (3). Consequently, the rate at which the defrost fluid heats the refrigerant within the refrigerant tube (3) is significantly higher. Therefore, the ice blocks are heated and detached from the outer surface of the refrigerant tube (3) at a faster rate. The rate at which the ice blocks are harvested significantly improves as a result of the above-mentioned configuration of the first metal plate (1) and the second metal plate enabling an angle of incidence (X) equal to 20 degrees for the defrost fluid. Also, the number of cooling and harvest cycles per day increases drastically due to the faster harvest cycle from the above-mentioned configuration and quantity of ice produced is significantly higher. Experimentally, it was found that the harvest cycle from the above-mentioned configuration required only about 45 seconds.

Figure 7:
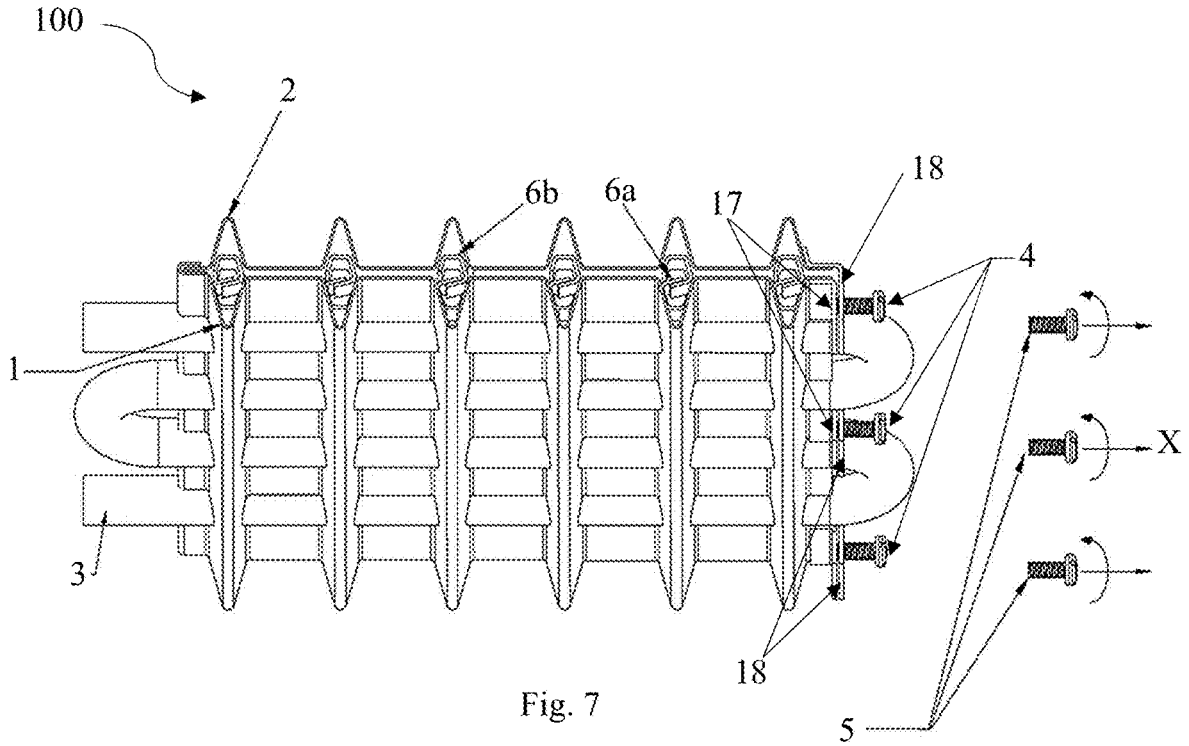
FIG. 7 illustrates a top perspective view of the evaporator with a plurality of connectors in first stage of dis-assembled condition in which clamping screws are removed, in accordance with an embodiment of the present disclosure.
Figure 8:
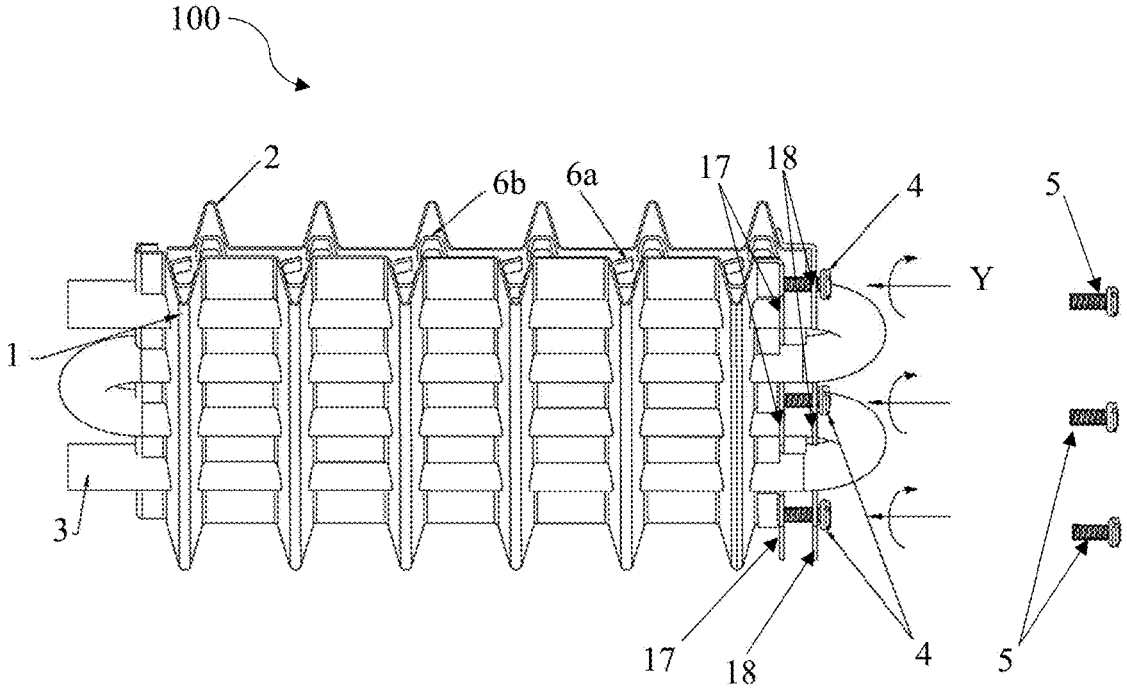
FIG. 8 illustrates a top perspective view of the evaporator in dis-assembled condition, in second stage of disassembly where puller screws are tightened to separate both plates, in accordance with an embodiment of the present disclosure.
Figure 9:
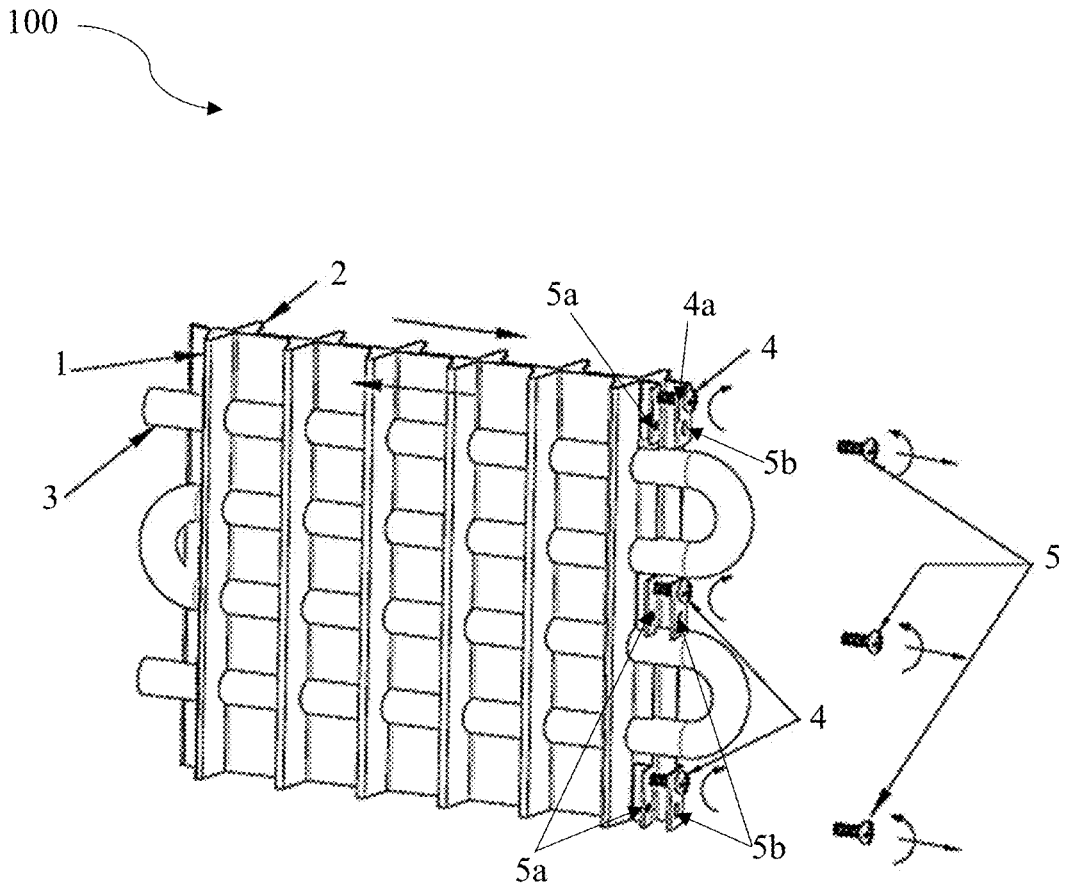
FIG. 9 illustrates front perspective view of the evaporator in a disassembled condition, in accordance with an embodiment of the present disclosure.

Now referring to FIG. 7 and FIG. 8 which illustrate an assembled top perspective view and a disassembled view of the evaporator assembly (100) respectively. Further, FIG. 9 illustrates a disassembled front perspective view of the evaporator assembly (100). As show in the FIG. 7, the second fasteners (5) are initially un-fastened from the first hole (5*a*) and the second hole (5*b*) of the first flange (17) and the second flange (18) respectively. As seen from FIG. 7, the second fasteners (5) may be rotated in an anti-clockwise direction and may completely be removed from the first flange (17) and the second flange (18). Once, the second fasteners (5) are removed, the first fasteners (4) may be rotated in a clockwise direction as seen from FIGS. 8 and 9.

In an embodiment, the first fasteners (4) are known as pusher screws. The first fastener (4) is configured through a single third hole (4*a*) of the second flange (18). The first flange (17) which is configured adjacent and behind the second flange (18) does not include any hole for accommodating the first fastener (4). Thus, tightening of the first fastener (4) causes the first fastener (4) to come in direct contact with the first flange (17). When the first fastener (4) is further tightened, as seen from FIG. 7 and FIG. 8, the rear end of the first fastener (4) pushes against the first flange (17) causing the first flange, (17) to be detached or disconnected from the second flange (18) in a second direction (Y). As the first flange (17) is pushed away by the tightening of the first fastener (4) in the second direction (Y), the first metal plate (1) also slides backwardly. Consequently, the first tension member (7*a*) of the first connector (6*a*) slips away from the second tension member (7*b*) of the plurality of the second connector (6*b*) and the first metal plate (1) is disconnected from the second metal plate (2). Thus, the first fastener (4) assists in disassembling the first metal plate (1) from the second metal plate (2) when excessive calcium or other mineral deposits obstruct the disassembly of the evaporator assembly (100).

Figure 10:
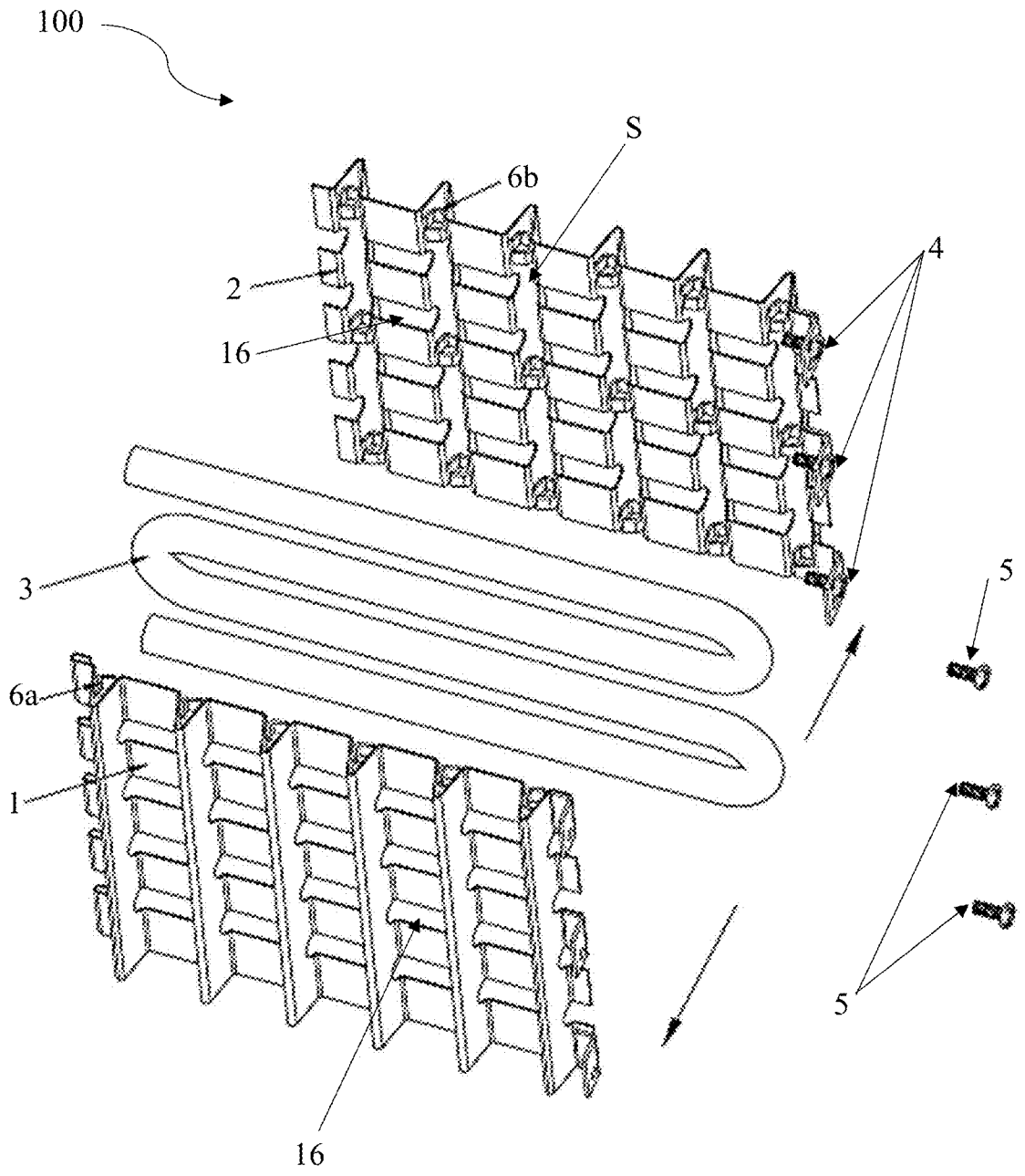
FIG. 10 illustrates an exploded view of the evaporator after dis-assembling, in accordance with an embodiment of the present disclosure.

FIG. 10 illustrates an exploded view of the evaporator assembly (100). Once the evaporator assembly (100) is disassembled in the above-mentioned manner, the first metal plate (1), the second metal plate (2) and the refrigerant tube (3) may be easily cleaned. Since, the evaporator assembly (100) is completely disassembled, all the parts and surfaces of the evaporator assembly (100) may easily be accessed and a thorough cleaning of every component in the evaporator assembly (100) may be achieved. Thus, periodic maintenance of the evaporator assembly (100) ensures that no bacterial formation on the ice forming surfaces (Z) or on the refrigerant tubes (3) result in un-hygienic operational conditions. The above configuration of the connectors (6), flange (17 and 18), first and second fasteners (5 and 4) enable the user to disassemble the evaporator assembly (100) for periodic cleaning and maintenance and thereby ensure a high degree hygiene is maintained in the evaporator assembly (100).

Figure 11:
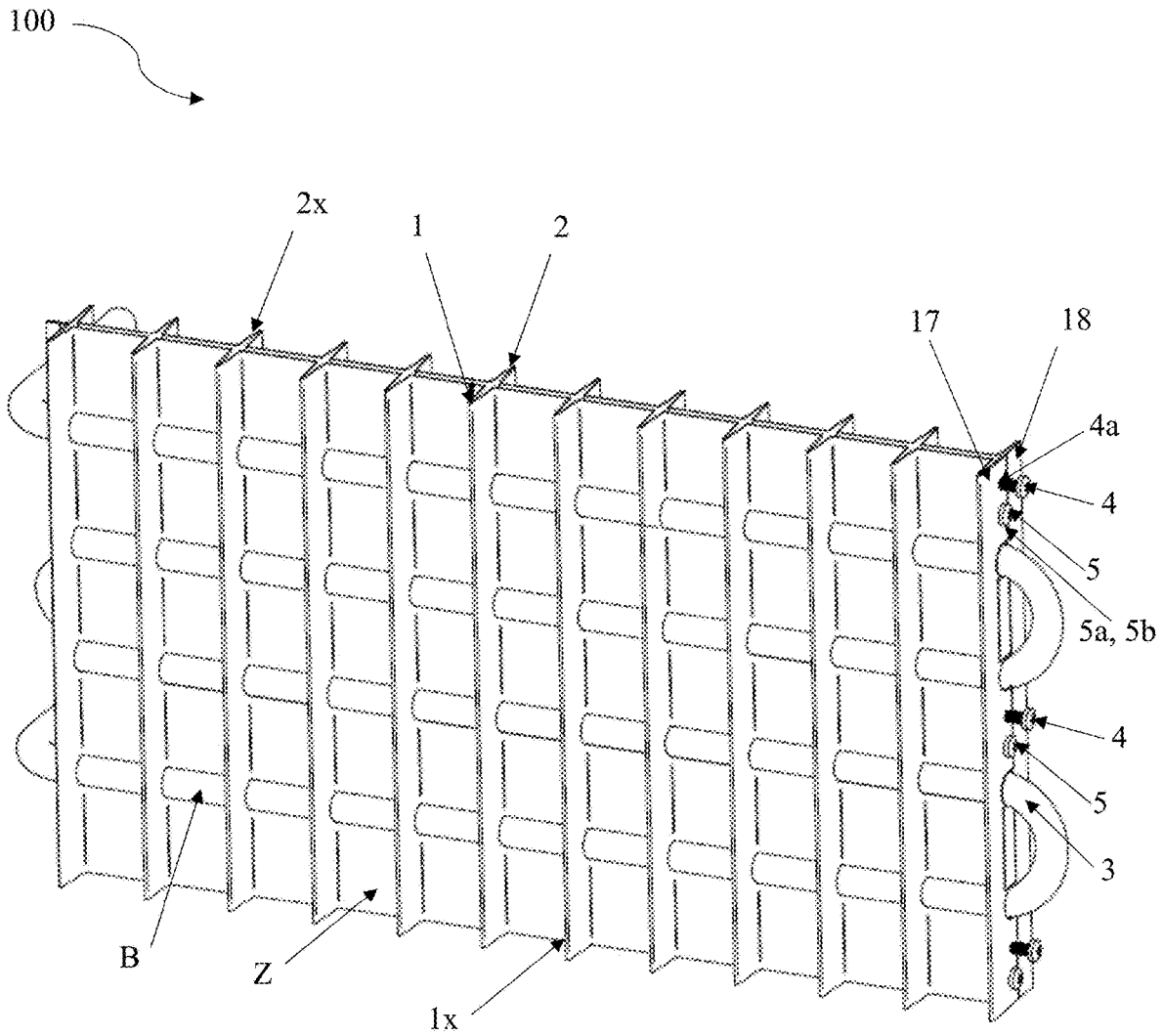
FIG. 11 and FIG. 12 is a front perspective view illustrating an embodiment of the evaporator of FIG. 1, in accordance with an embodiment of the present disclosure.
Figure 12:
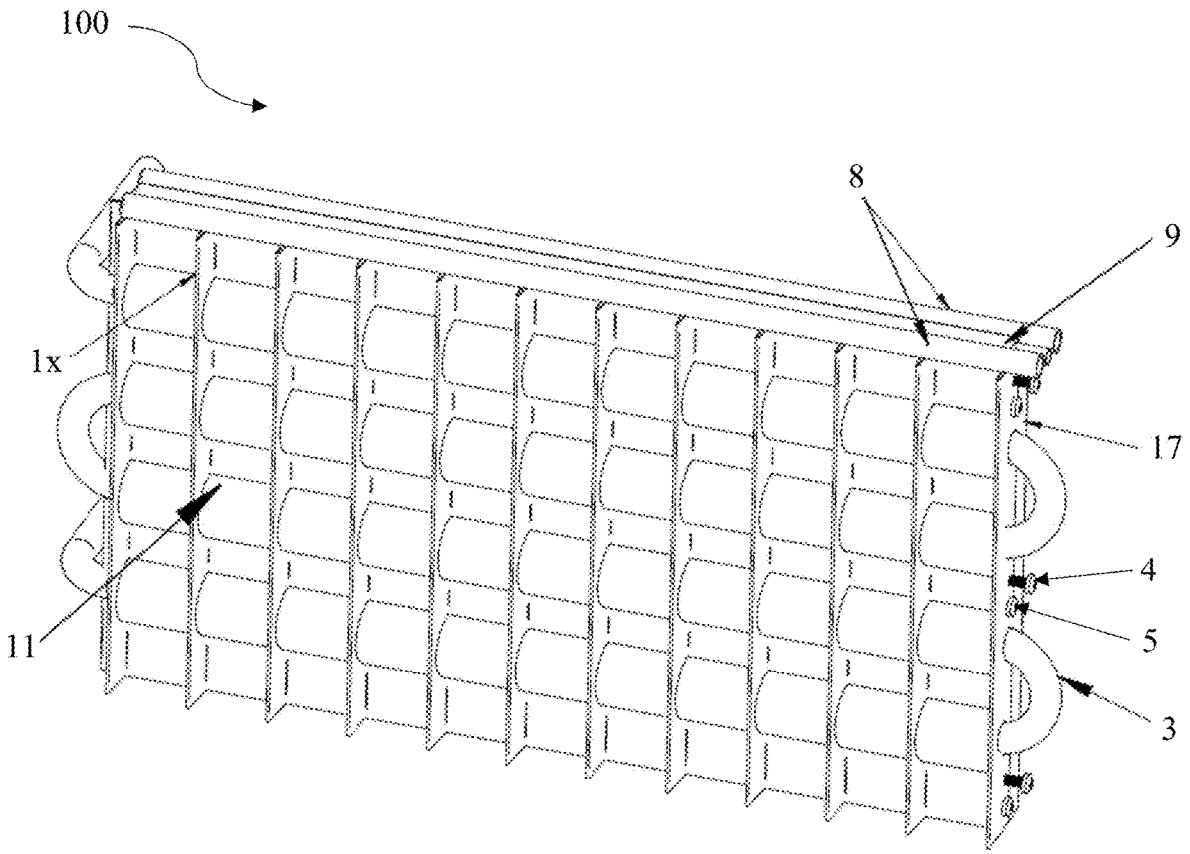

FIG. 11 and FIG. 12 is a front perspective view illustrating an embodiment of the evaporator assembly (100). Similar to the above-mentioned preferable embodiment, the evaporator assembly (100) herein also includes the first metal plate (1) and the second metal plate (2). The first metal plate (1) and the second metal plate (2) are defined with the plurality of projections (1*x* and 2*x*) extending from the first major surface (19), where each of the plurality of projections (1*x* and 2*x*) may define a slot (S) in a corresponding second major surface (20) opposite to the first major surface (19) of corresponding first metal plate (1) and the second metal plate (2) respectively. The first metal plate (1) and the second metal plate (2) are of a similar configuration as mentioned above. Further, the inner sections of the first metal plate (1) and the second metal plate (2) may be carved by the plurality of cut outs (16). The cut outs (16) carved out into the first metal plate (1) and the second metal plate (2) may be configured at the top end of the "V" shaped projections (1*x* and 2*x*) and along the ice forming surface (Z) of the first metal plate (1) and the second metal plate (2). The circular cut outs (16) may extend along the central region of the evaporator assembly (100) and the cut outs (16) carved on to the first metal plate (1) and the second metal plate (2) may be configured to compactly accommodate the refrigerant tube (3).

The front end of the first metal plate (1) may be configured to define at least one first flange (17) and the second metal plate (2) may also be configured to define at least one second flange (18). The first flange (17) and the second flange (18) may be defined in a direction perpendicular to the ice forming surface (Z). The first flange (17) and the second flange (18) may be an integral part of the first metal plate (1) and the second metal plate (2) respectively and may be stamped or deformed in a direction perpendicular to the ice forming surfaces (Z), in this particular embodiment, the first flange (17) and the second flange (18) may each configured to be a single component that extend throughout the height of the evaporator assembly (100). The first flange (17) may be configured to partially extend over the second flange (18) to define an intermediate section where both the first flange (17) and the second flange (18) are in contact with each other. In an embodiment, the first flange (17) may extend over the second flange (18) such that the intermediate overlapping section may be defined along the centre of the evaporator assembly (100). The first hole or aperture (5*a*) may be defined on the intermediate overlapping section such that the first hole (5*a*) extends through the first flange (17) and the second flange (18) may be defined with a second hole (5*b*) that extend through the second flange (18). The first hole (5*a*) and the second hole (5*b*) on the first flange (17) and the second flange (18) respectively may be configured to lie along the same axis when the first flange (17) and the second flange (18) that are positioned adjacent to each other. The first hole (5*a*) and the second hole (5*b*) of the first flange (17) and the second flange (18) respectively, may accommodate the second fastener (5). The second fastener (5) may be fastened into the first hole (5*a*) and the second hole (Sb) of the first flange (17) and the second flange (18) respectively such that the first flange (17) is fixedly connected to the second flange (18). Further, the second flange (18) may be defined by a third hole (4*a*) which extends through the second flange (18). The third hole (4*a*) may be configured to accommodate the first fastener (4).

Figure 13:
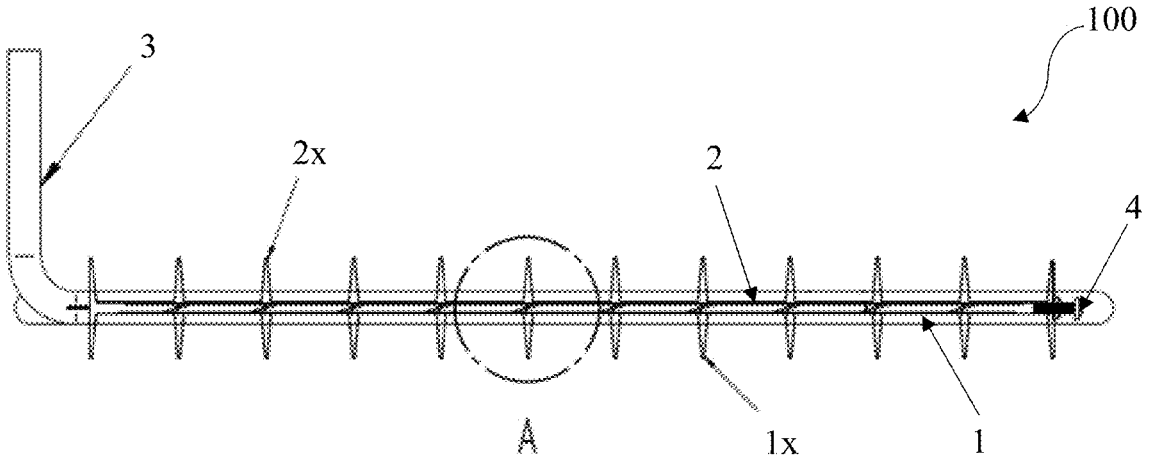
FIG. 13 is a top view of an embodiment of the evaporator of FIG. 1, in accordance with an embodiment of the present disclosure.
Figure 14:
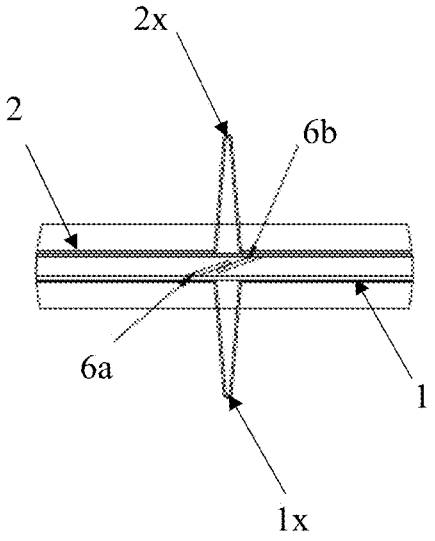
FIG. 14 is an enlarged top view of section A of the evaporator from FIG. 13, in accordance with an embodiment of the present disclosure.

FIG. 13 is a top view of an embodiment of the evaporator assembly (100) and FIG. 14 is an enlarged top view of section A of the evaporator from FIG. 13. The one or more slots (S) defined in the second major surface (20) of first metal plate (1) accommodates the plurality of first connectors (6*a*), and the one or more slots (S) defined in the second major surface (20) of second metal plate (2) accommodates the plurality of second connectors (6*b*). The inner surfaces of each of the "V" shaped first and second projections (1*x* and 2*x*) may be provided with the plurality of first connectors (6*a*) and the plurality of second connectors (6*b*) respectively. As seen from the FIG. 2, the inner surfaces of each of the "V" shaped first projections (1*x*) on the first metal plate (1) are provided with plurality of first connectors (6*a*). The plurality of first connectors (6*a*) may be provided throughout the length of each of the first projections (1*x*) of the first metal plate (1). Further, the plurality of first connectors (6*a*) may be straight elongated members and may be the tension member. The plurality of first connectors (6*a*) are defined on a first locking strip (6*y*) [clearly seen from FIG. 17] and the first metal plate (1) extends throughout the length of the evaporator assembly (100). Plurality of first locking strip (6*y*) with plurality of first connectors (6*a*) may be configured to the first metal plate (1). The plurality of first connectors (6*a*) may be cut our and formed to define the elongated member which acts like the tension member. Similarly, the inner surfaces of each of the "V" shaped second projections (2*x*) on the second metal plate (2) are provided with plurality of second connectors (6*h*). The plurality of the second connectors (6*h*) may be provided throughout the length of each of the second projections (2*x*) of the second metal plate (2). Further, the plurality of the second connectors (6*b*) may be straight elongated members and may be the tension member. The plurality of the second connectors (6*b*) are defined on a second locking strip (6*x*) [clearly seen from FIG. 17] and the second locking strip (6*x*) extends throughout the length of the evaporator assembly (100). Plurality of second locking strip (6*x*) with the plurality of the second connectors (6*b*) may be configured to the second metal plate (2). The plurality of the second connectors (6*h*) may be cut out and formed to define the elongated member which acts like the tension member. Further, during assembling of the evaporator assembly (100), the first metal plate (1) is slid against the second metal plate (2) in a first direction (X) such that the plurality of first connectors (6*a*) and the plurality of second connectors (6*b*) engage with each other to secure the first metal plate (1) and the second metal plate (2). The tension between the plurality of first connectors (6*a*) and the plurality of second connectors (6*b*) holds the first metal plate (1), the second metal plate (2) and the refrigerant tube (3) together.

Figure 15:
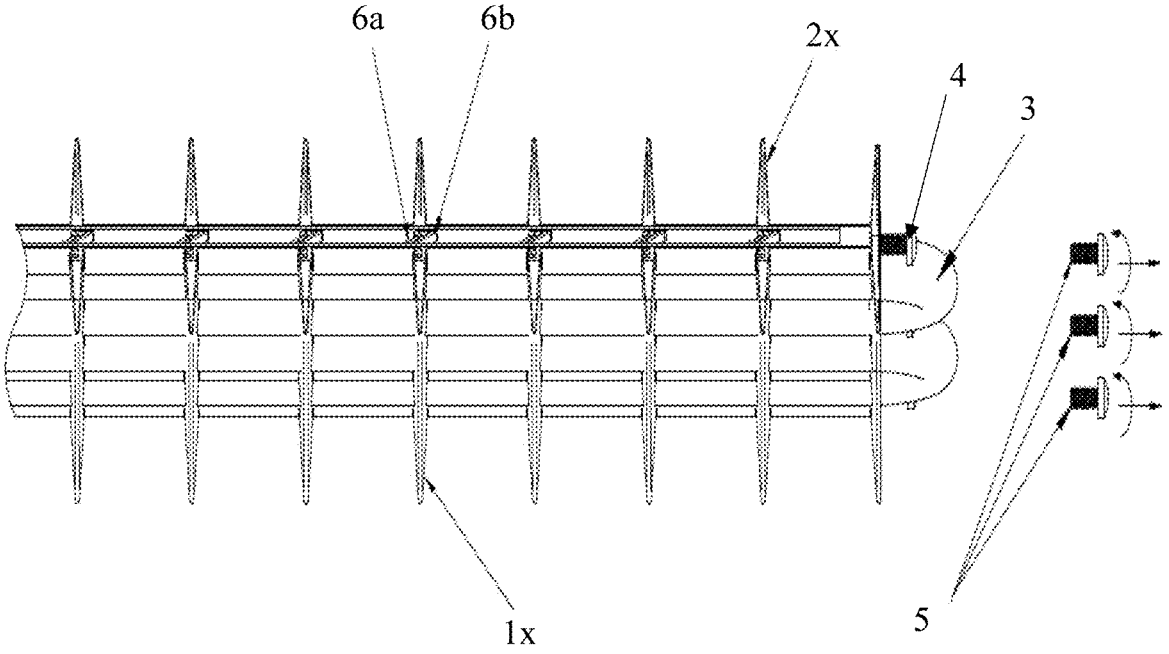
FIG. 15 is a top perspective view illustrating an embodiment of the evaporator with a plurality of connectors in first stage of d is-assembled condition in which clamping screws are removed, in accordance with an embodiment of the present disclosure.
Figure 16:
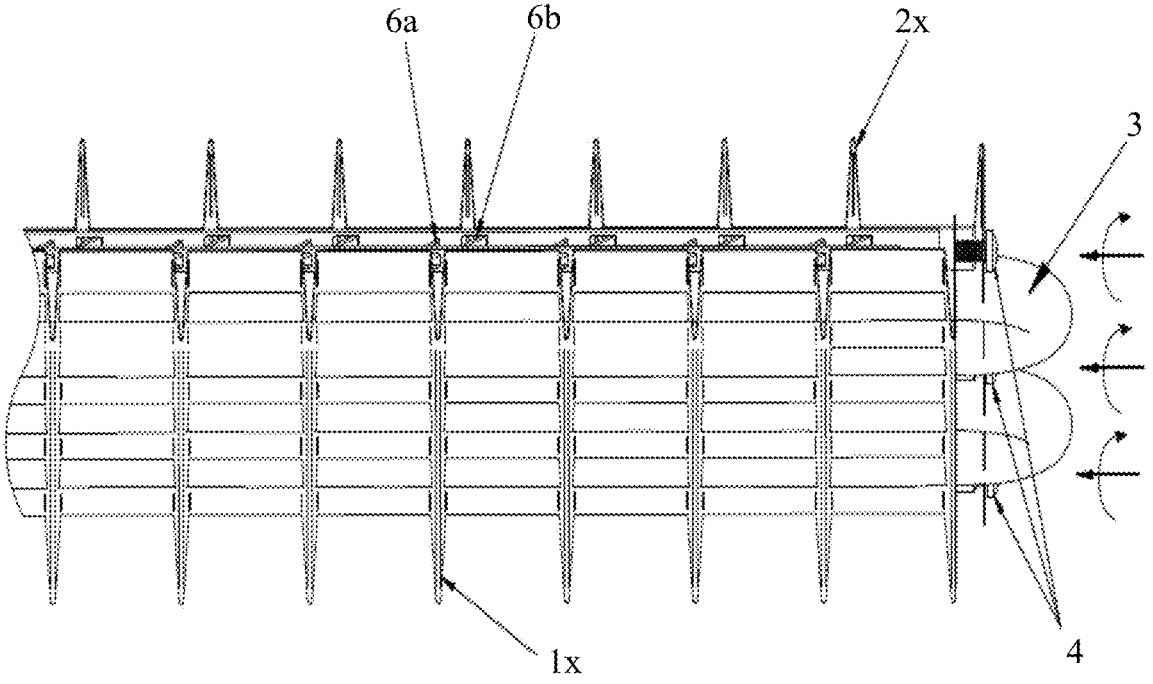
FIG. 16 is a top perspective view illustrating an embodiment of the evaporator in dis-assembled condition, in second stage of disassembly where puller screws are tightened to separate both plates, in accordance with an embodiment of the present disclosure.
Figure 17:
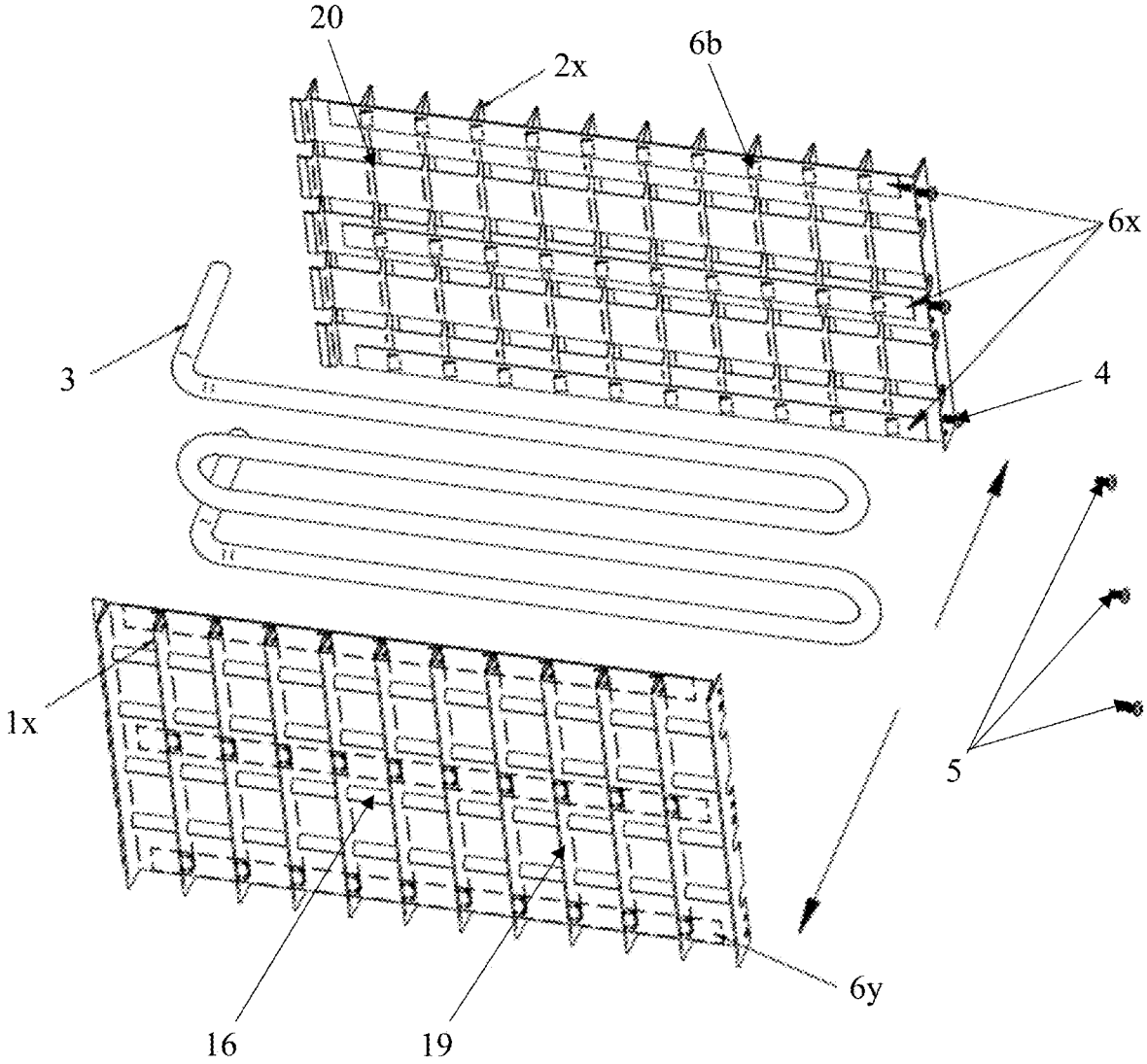
FIG. 17 is an exploded view illustrating an embodiment of the evaporator after dis-assembling, in accordance with an embodiment of the present disclosure

FIG. 15 is a top perspective view illustrating an embodiment of the evaporator assembly (100) with the plurality of connectors (6*a* and 6*b*) in first stage of dis-assembled condition in which clamping screws (5) are removed. FIG. 16 is a top perspective view illustrating an embodiment of the evaporator assembly (100) in dis-assembled condition, in second stage of disassembly where puller screws (4) are tightened to separate both plates (1 and 2) and FIG. 17 is an exploded view illustrating an embodiment of the evaporator assembly (100) after dis-assembling. The removal of clamping screws (5) and the tightening of the puller screws (4) is similar to the process illustrated for the above preferable embodiment.

Figure 18:
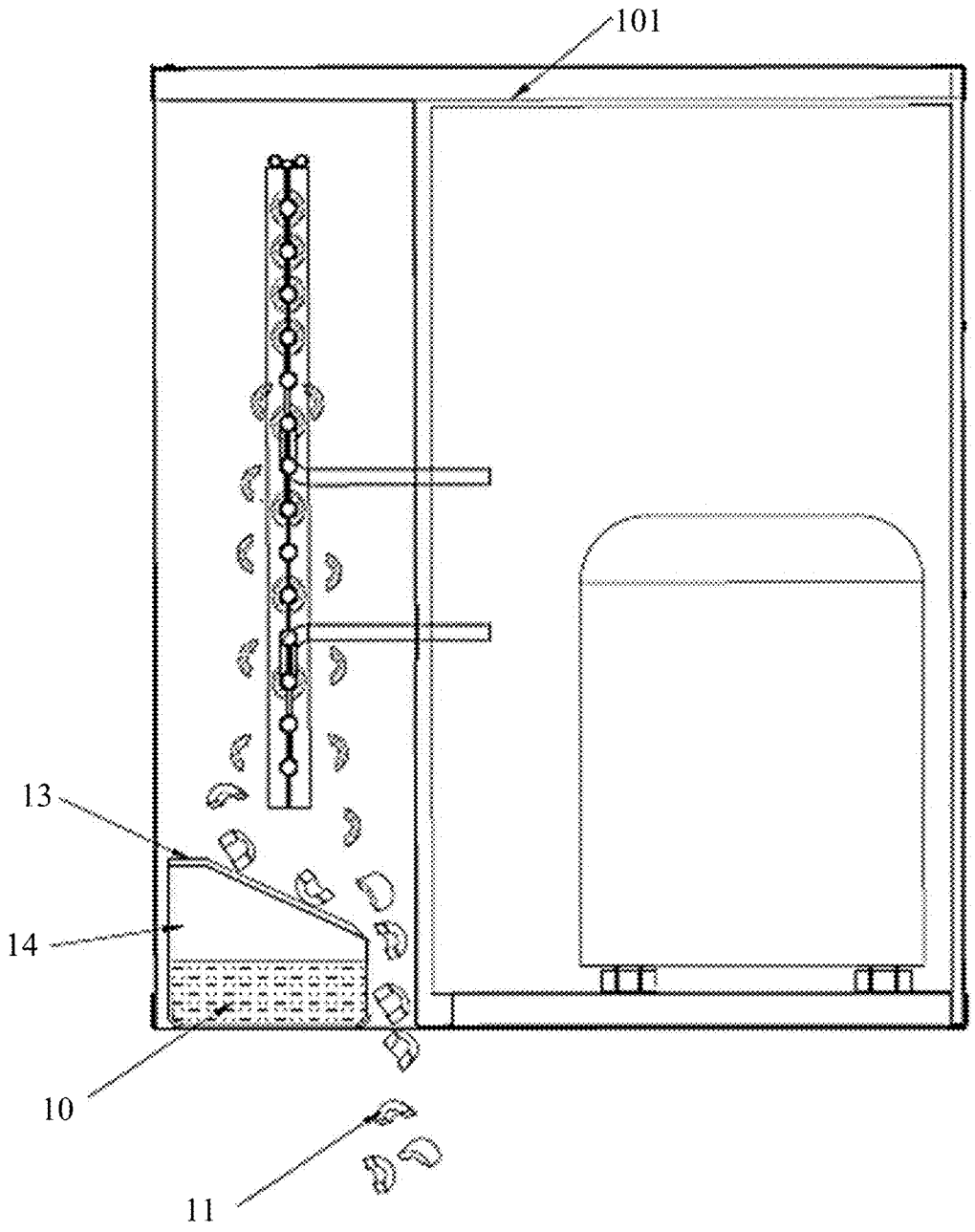
FIG. 18 illustrates a side view of a vertical flow type ice making machine, in accordance with an embodiment of the present disclosure.
Figure 19:
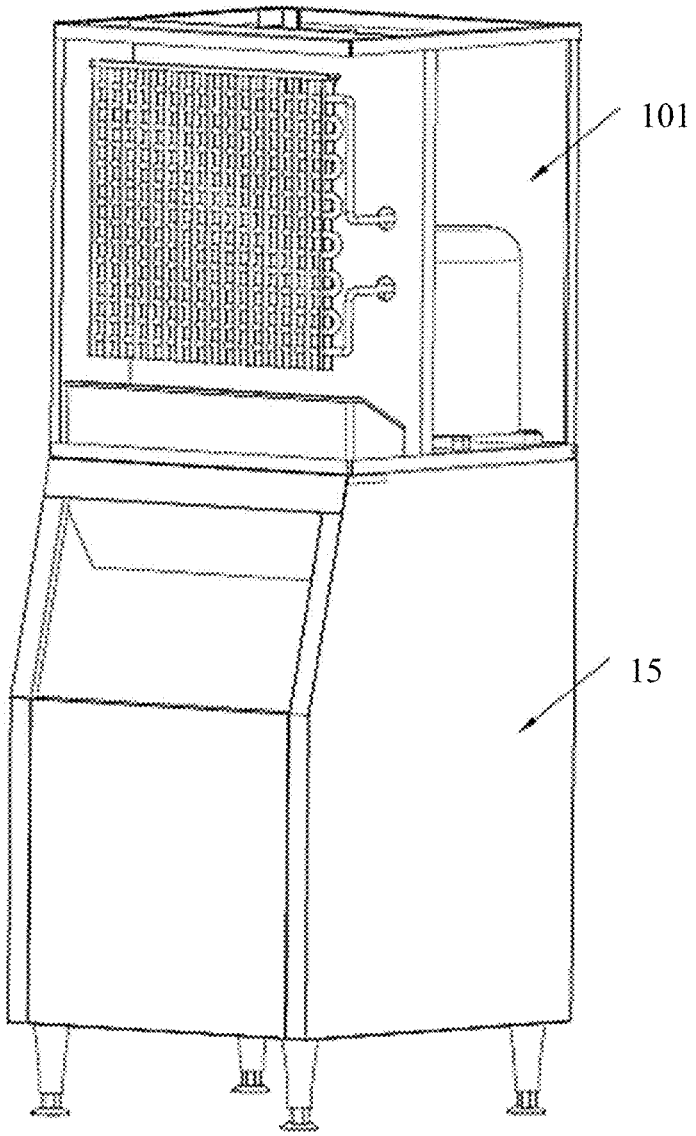
FIG. 19 illustrates a perspective view of a vertical flow type ice making machine, in accordance with an embodiment of the present disclosure.

FIG. 18 and FIG. 19 illustrate a side view and a perspective view of a vertical flow type ice making machine (101) with the evaporator assembly (100) respectively. In an embodiment of the disclosure, the evaporator assembly (100) alone with the fluid tank (14) may be provided in an ice making machine (101). The ice blocks that are formed by the evaporator assembly (100) may slide by means of an ice slide (13) and may be acquired in a container (15) inside the ice making machine (101).

In an embodiment of the disclosure, the evaporator assembly (100) configuration with the connectors (6), flange (17 and 18), first and second fasteners (5 and 4), enable the easy assembly and disassembly of the evaporator assembly (100) for periodic cleaning and maintenance.

In an embodiment of the disclosure, the disassembly and cleaning of the evaporator assembly (100) ensure and enable the user to maintain greater hygiene standards.

In an embodiment of the disclosure, overall heat transfer between the refrigerant tubes (3) and the fluid that is to be converted to ice is improved since the fluid comes in direct contact with the refrigerant tube (3).

In an embodiment of the disclosure, the rate at which the fluid converts to ice is improved and ice blocks of required shape and size may be produced in a short span of time.

In an embodiment of the disclosure, the overall operational efficiency of the evaporator assembly (12) is improved by enabling the ice to be directly formed on the refrigerant tube (3).

In an embodiment of the disclosure, the rate at which the ice blocks are harvested is significantly improved as a result of the above-mentioned configuration of the first metal plate (1) and the second metal plate enabling an angle of incidence (X) equal to 20 degrees for the defrost fluid.

In an embodiment, the ice blocks (11) are directly formed on the refrigerant tube (3) in the above-mentioned configuration of the evaporator assembly (100). Consequently, due to this configuration the usage of an additional copper plates adjacent to the refrigerant tube (3) for formation of the ice blocks may be avoided. Therefore, the usage of copper is minimized, and the overall manufacturing cost of the evaporator assembly (100) is economical. Further, since the evaporator assembly (100) is configured to be removable by means of the plurality of first and second connectors (6*a* and 6*b*). Therefore, the above configuration of the evaporator assembly (100) allows mitigation of usage of tin for fabrication of the evaporator assembly (100). In view of this, rusting of tin material is also mitigated and better hygiene standards are enabled.

EQUIVALENTS

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding the description may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A. B, and C" would include but not be limited to systems that have A alone, B alone, C alone. A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone. A and B together, A and C together, B and C together, and/or A, B, and C together, etc.). It will be further understood by those within the art that virtually any disjunctive word and/or phrase presenting two or more alternative terms, whether in the description, or drawings, should be understood to contemplate the possibilities of including one of the terms, either of the terms, or both terms. For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated in the description.

Table of Referral Numerals:

| Referral numerals | Description |
|---|---|
| 1 | First metal plate |
| 1x | First projections |
| 2 | Second metal plate |
| 2x | Sccond projections |
| 3 | Refrigerant tube |
| 4 | Puller Screws |
| 4a | Threaded hole |
| 5 | Clamping Screws |
| 5a | Threaded hole |
| 5b | Hole |
| 6a | First connectors |
| 6b | Second connectors |
| 6y | First locking strip |
| 6x | Second locking strip |
| 7a | First tension member |
| 7b | Second tension member |
| 8 | Water flow lines |
| 9 | Fresh water line |
| 10 | Water |
| 11 | Ice |
| 12 | Fresh Water flow |
| 13 | Ice slide |
| 14 | Water container |
| 15 | Ice Storage Bin |
| 16 | Cut outs |
| 17 | First flange |
| 18 | Second flange |
| 19 | First major surfacc |
| 20 | Second major surface |
| 21 | Housing |
| X | First direction |
| Y | Second direction |
| S | Slot |

We claim:

1. A removable evaporator assembly for an ice making machine, the evaporator assembly comprising:

a first metal plate and a second metal plate accommodating a refrigerant tube wherein, the first metal plate and the second metal plate are defined with a plurality of cut outs extending horizontally through-out the length of the first metal plate and the second metal plate for accommodating the refrigerant tube;

a first flange connected to one end of the first metal plate; and at least one second flange connected to one end of the second metal late, wherein, the first flange and the at least one second flange fixedly secure the first metal plate, the second metal plate and the refrigerant tube;

wherein each of the first metal plate and the second metal plate is defined with a plurality of projections extending from a first major surface, wherein each of the plurality of projections defines one or more slots in a second major surface opposite to the first major surface of the corresponding first metal plate and the second metal plate, wherein, the one or more slots defined in the second major surface of the first metal plate comprises a plurality of first connectors with a first tension member, and the one or more slots defined in the second major surface of the second metal plate comprises a plurality of second connectors with a second tension member, wherein the second major surface of each of the first metal plate and the second metal plate contacts the refrigerant tube wherein the first metal plate and the second metal plate are removably connected, and at least one of the first metal plate and the second metal plate is movable relative to the other such that, the first tension member of plurality of first connectors and the second tension member of plurality of second connectors removably engage with each other by generating a tugging force to secure the first metal plate and the second metal plate when at least one of the first metal plate and the second metal plate is moved in a first direction, and wherein the at least one second flange is defined with a hole for accommodating a first fastener and the first fastener dislodges the first metal plate by pushing against the at least one second flange of the second metal plate for disassembling the evaporator assembly.

2. The evaporator assembly as claimed in claim 1, wherein the plurality of first connectors and the plurality of second connectors disengage with each other and separate the first metal plate and the second metal plate when the first metal plate and the second metal plate are moved in a second direction for removing the evaporator assembly.

3. The evaporator assembly as claimed in claim 1, wherein the plurality of projections are at least one of first projections and second projections extending vertically along the length of the first metal plate and the second metal plate, respectively.

4. The evaporator assembly as claimed in claim 1, wherein the plurality of first connectors and the plurality of second connectors frictionally engage with each other.

5. The evaporator assembly as claimed in claim 1, wherein the plurality of first and second projections are defined equidistant from each other on respective first and second metal plates.

6. The evaporator assembly as claimed in claim 1, wherein each of the plurality of first and second projections is of a "V" shaped configuration.

7. The evaporator assembly as claimed in claim 1, wherein the plurality of first and second projections defined on the first major surface comprises a plurality of ice forming surfaces.

8. The evaporator assembly as claimed in claim 1, comprises a housing at a rear end of the first metal plate, wherein the housing accommodates an extension from a rear end of the second metal plate.

9. The evaporator assembly as claimed in claim 1, wherein the first metal plate and the second metal plate are made of low thermal conductivity material and the refrigerant tube is of a high thermal conductivity material.

10. The evaporator assembly as claimed in claim 1, wherein the refrigerant tube protrudes outwardly from the cut outs in the first and second metal plates and a semi-circular shape is imparted to the ice blocks forming on the refrigerant tube.

11. The evaporator assembly as claimed in claim 1, wherein the refrigerant tube receives dispersed water to form ice blocks such that a semi-circular shape is imparted to the ice blocks formed on the refrigerant tube.

12. A method of assembling a removable evaporator assembly in an ice making machine, the method comprising:

aligning a first metal plate and a second metal plate adjacent to each other along with a refrigerant tube wherein a first flange is connected to one end of the first metal plate and at least one second flange is connected to one end of the second metal plate, wherein, the first flange and the at least one second flange fixedly secure the first metal plate, the second metal plate and the refrigerant tube;

wherein, the first metal plate and the second metal plate are defined with a plurality of projections extending from a first major surface, wherein each of the plurality of projections defines a slot in a second major surface opposite to the first major surface of the first metal plate and the second metal plate;

wherein, the one or more slots defined in the second major surface of the first metal plate comprises a plurality of first connectors with a first tension member, and wherein the one or more slots defined in the second major surface of the second metal plate comprises a second connector with a second tension member; and sliding at least one of the first metal plate and the second metal plate in a first direction such that the first tension member of the plurality of first connectors and the second tension member of the second connector removably engage with each other to secure the first metal plate and the second metal plate;

fastening at least one second fastener to a first hole of a first flange and a second hole of a second flange for fixedly connecting the first metal plate and the second metal plate, and wherein the at least one second flange is defined with a hole for accommodating a first fastener and the first fastener dislodges the first metal plate by pushing against the at least one second flange of the second metal plate for disassembling the evaporator assembly.

13. A vertical flow type ice making machine, the machine comprising:

one or more removable evaporator assemblies, each of the one or more evaporator assemblies comprising:

a first metal plate and a second metal plate accommodating a refrigerant tube;

a first flange connected to one end of the first metal plate; and at least one second flange connected to one end of the second metal plate, wherein, the first flange and the at least one second flange fixedly secures the first metal plate, the second metal plate and the refrigerant tube, wherein each of the first metal plate and the second metal plate is defined with a plurality of projections extending from a first major surface, wherein each of the plurality of projections defines a slot in a second major surface opposite to the first major surface of the first metal plate and the second metal plate;

wherein, the one or more slots defined in the second major surface of the first metal plate comprises a plurality of first connectors with a first tension member, and wherein the one or more slots defined in the second major surface of the second metal plate comprises a second connector with a second tension member, wherein the second major surface of each of the first metal plate and the second metal plate contacts the refrigerant tube when the first metal plate and the second metal plate are connected, and wherein at least one of the first metal plate and the second metal plate is movable relative to the other such that the first tension member of the plurality of first connectors and the second tension member of the second connector removably engage with each other to secure the first metal plate and the second metal plate when the at least one of the first metal plate and the second metal plate is moved in a first direction, wherein the plurality of first connectors and the plurality of second connector disengage with each other and separate the first metal plate and the second metal plate when the first metal plate and the second metal plate are moved in a second direction, and wherein the at least one second flange is defined with a hole for accommodating a first fastener and the first fastener dislodges the first metal plate by pushing against the at least one second flange of the second metal plate for disassembling the evaporator assembly.

* * * * *